US009187905B2

(12) United States Patent
Smith

(10) Patent No.: US 9,187,905 B2
(45) Date of Patent: Nov. 17, 2015

(54) ROOF OR WINDOW PANEL TO METAL ROOFING OR SIDING INTERFACE SECUREMENT SYSTEM

(71) Applicant: Jeffrey A. Smith, Lenox Dale, MA (US)

(72) Inventor: Jeffrey A. Smith, Lenox Dale, MA (US)

( * ) Notice: Subject to any disclaimer, the term of this patent is extended or adjusted under 35 U.S.C. 154(b) by 0 days.

(21) Appl. No.: 13/827,805

(22) Filed: Mar. 14, 2013

(65) Prior Publication Data

US 2014/0123569 A1 May 8, 2014

Related U.S. Application Data

(60) Provisional application No. 61/723,131, filed on Nov. 6, 2012.

(51) Int. Cl.

| | |
|---|---|
| ***E04B 1/68*** | (2006.01) |
| ***E04D 13/03*** | (2006.01) |
| ***E04D 13/00*** | (2006.01) |
| *E04D 13/15* | (2006.01) |
| *E04D 13/147* | (2006.01) |

(52) U.S. Cl.

CPC ..... *E04D 13/00* (2013.01); *E04D 13/03* (2013.01); *E04D 13/147* (2013.01); *E04D 13/15* (2013.01)

(58) Field of Classification Search

CPC ..... E04B 7/18; E04B 1/68; E04B 1/684; E04D 13/03; E04D 13/00; E04D 13/15; E04D 13/14; E04D 13/147; E04D 1/36; E04D 1/365; E04D 3/36

USPC ..... 52/173.3, 218, 219, 200, 198, 57, 60

See application file for complete search history.

(56) References Cited

U.S. PATENT DOCUMENTS

| | | | | |
|---|---|---|---|---|
| 4,193,237 | A * | 3/1980 | Jankowski | 52/200 |
| 4,372,292 | A * | 2/1983 | Ort | 126/622 |
| 4,730,421 | A * | 3/1988 | Leeland | 52/58 |
| 4,776,141 | A * | 10/1988 | Powell | 52/200 |
| 4,987,705 | A * | 1/1991 | Sampson et al. | 52/72 |
| 5,018,333 | A | 5/1991 | Bruhm | |
| 5,044,133 | A * | 9/1991 | Sampson et al. | 52/72 |
| 5,299,396 | A * | 4/1994 | Rap et al. | 52/90.1 |

(Continued)

FOREIGN PATENT DOCUMENTS

| | | | |
|---|---|---|---|
| DE | 3603303 | A1 | 8/1987 |
| DE | 10057774 | A1 | 10/2002 |

(Continued)

*Primary Examiner* — Phi A

(74) *Attorney, Agent, or Firm* — Hamilton, Brook, Smith & Reynolds, P.C.

(57) ABSTRACT

A securement system for a roof or window panel includes a first side structure which can secure and seal a first side of the roof or window panel and can include a first side structure panel having an outer side flange for integrating or interfacing with roofing or siding which can include insertion thereunder. A raised cricket can extend laterally inwardly from the outer side flange for directing water away from the first side of the roof or window panel. An engagement ridge can extend along or from an inner edge of the cricket for engaging a retention structure extending along the first side of the roof or window panel. An open polygonal channel cap can have an outer edge for engaging at least one of the engagement ridge of the first side panel cricket and the retention structure, and an inner edge for engaging the roof or window panel. The cap can be capable of being resiliently snapped in place and provide water proofing and rigidity to the first side structure.

12 Claims, 18 Drawing Sheets

(56) References Cited

U.S. PATENT DOCUMENTS

| | | | | |
|---|---|---|---|---|
| 5,682,713 | A * | 11/1997 | Weiss | 52/200 |
| 6,640,508 | B2 * | 11/2003 | Lindgren et al. | 52/200 |
| 6,966,157 | B1 | 11/2005 | Sandow | |
| 7,059,086 | B2 | 6/2006 | Edvardsen | |
| 7,308,777 | B2 | 12/2007 | Sandow | |
| 7,331,145 | B2 * | 2/2008 | Feucht et al. | 52/58 |
| 8,191,317 | B2 * | 6/2012 | Lundsgaard et al. | 52/72 |
| 8,404,963 | B2 * | 3/2013 | Kobayashi | 136/244 |
| 8,448,393 | B2 * | 5/2013 | Voegele et al. | 52/200 |
| 2002/0095883 | A1 * | 7/2002 | Lindgren et al. | 52/200 |
| 2006/0272232 | A1 * | 12/2006 | Fooks | 52/200 |
| 2010/0018138 | A1 * | 1/2010 | Lundsgaard et al. | 52/200 |
| 2010/0287858 | A1 | 11/2010 | Israeli et al. | |
| 2012/0051833 | A1 | 3/2012 | Israeli et al. | |
| 2012/0233942 | A1 | 9/2012 | McLain et al. | |
| 2012/0240491 | A1 * | 9/2012 | Voegele et al. | 52/200 |

FOREIGN PATENT DOCUMENTS

| | | | |
|---|---|---|---|
| EP | 0974711 | A3 | 2/2001 |
| WO | WO 2004/051026 | A1 | 6/2004 |
| WO | WO 2006/002629 | A1 | 1/2006 |

* cited by examiner

ROOF OR WINDOW PANEL TO METAL ROOFING OR SIDING INTERFACE SECUREMENT SYSTEM

RELATED APPLICATION(S)

This application claims the benefit of U.S. Application No. 61/723,131, filed Nov. 6, 2012.

The entire teachings of the above application are incorporated herein by reference.

BACKGROUND

Roof or window panels require interfaces to secure and seal the panels to the roof or side of a structure, and leaking or insufficient securement can sometimes occur in some existing installations.

SUMMARY

The present invention can provide a roof or window panel to roofing or siding interface securement system, which can provide sufficient securement and sealing for roof or window panels in a simple and easy manner.

The present invention can provide a securement system for a roof or window panel including a first side structure which can secure and seal a first side of the roof or window panel and can include a first side structure panel having an outer side flange for integrating or interfacing with roofing or siding which can include insertion thereunder. A raised cricket can extend laterally inwardly from the outer side flange for directing water away from the first side of the roof or window panel. An engagement ridge can extend along or from an inner edge of the cricket for engaging a retention structure extending along the first side of the roof or window panel. An open polygonal channel cap can have an outer edge for engaging at least one of the engagement ridge of the first side panel cricket and the retention structure, and an inner edge for engaging the roof or window panel. The cap can be capable of being resiliently snapped in place and provide water proofing and rigidity to the first side structure.

In particular embodiments, a header panel can be included having an outer header flange for integrating or interfacing with or insertion under roofing or siding. A raised cricket can extend downhill or inwardly from the outer header flange for directing water away from an upper end of the roof or window panel. The cricket can have a slot for accepting and trapping an upper edge of the roof or window panel. An inner flange can extend downhill or inwardly from the cricket below the slot for securement to the roof or side of a building or structure. A second side structure can secure and seal a second side of the roof or window panel. A sill panel can be included having an outer sill flange for integrating or interfacing with or positioning over roofing or siding. An inner sill flange can extend uphill or inwardly from the outer sill flange for securement to the roof or side of the structure. An uphill facing retention slot can extend downhill or outwardly from the inner sill flange over at least a portion of the inner sill flange for receiving and trapping a lower edge of the roof or window panel. The header panel, side panels, caps and sill panel can be formed from sheet metal. The retention structure can include at least one anchor bracket, member or clip secured to the first side of the roof or window panel. The at least one anchor member can engage a structure along the first side of the roof or window panel.

The header panel slot can include an exterior slot member and an interior slot member. The exterior slot member can include a first portion extending in the downhill direction from the raised cricket in a spaced relationship to the interior slot member, and a second portion can extend from the first portion towards the interior slot member for trapping the window panel between the second portion of the exterior slot member and the interior slot number. The header panel slot can be formed of sheet metal extending inwardly in the downhill direction from the raised cricket and bent to provide the first and second portions of the exterior slot member with two layers of sheet metal, and the interior slot member with one layer of sheet metal. The sheet metal forming the first portion of the exterior slot member can extend inwardly in the downhill direction from the raised cricket generally parallel to the interior slot member, and can be bent from the first portion and extend towards the interior slot member to form the second portion of the exterior slot member, and can be bent against and extend along the second portion and the first portion of the exterior slot member to form the second and first portions with a double sheet metal layer, and can be bent from the first portion of the exterior slot member towards the interior slot member to form an uphill member of the header panel slot, and can be bent inwardly in the downhill direction from the uphill member to form the interior slot member. At least a portion of at least one slot member can be capable of resilient deflection for gripping the window panel. The first portion of the exterior slot member can extend in the downhill direction from the raised cricket at least about 1 inch and the second portion can extend from the first portion about 1.2 inches.

The open polygonal channel cap can be elongate and can have a cross section with a laterally inwardly extending side panel engagement leg forming the outer edge for engaging the engagement ridge of the first side panel. An outer side wall can extend in an exterior direction from the side panel engagement leg. An exterior connecting wall can extend laterally inwardly from the outer side wall. An inner side wall can extend in the interior direction from the exterior connecting wall and terminate in an outwardly angled window panel engagement leg, forming the inner edge that extends in an angled direction toward the outer side wall and the exterior connecting wall. In the cross section of the open polygonal channel cap, the side panel engagement leg can be shorter than the exterior connecting wall. The inner side wall can be shorter than the outer side wall, and the window panel engagement leg can be shorter than the exterior connecting wall. The open polygonal channel cap can be formed of sheet metal, with respective corners between the side panel engagement leg and the outer side wall, between the outer side wall and the exterior connecting wall, between the exterior connecting wall and the inner side wall, and between the inner side wall and the window panel engagement leg. In the cross section of the open polygonal channel cap, the side panel engagement leg can be about 0.33 inches, the outer side wall can be about 1.3 inches, the exterior connecting wall can be about 0.95 inches, the inner side wall can be about 0.8 inches, and the window panel engagement leg can be about 0.25 inches. The open polygonal channel cap can have a cross section having a perimeter with 5 sides with an opening between the outer edge and the inner edge.

The engagement ridge of the side panel can extend laterally outwardly from the raised side panel cricket and can be generally channel shaped for engaging the open polygonal channel cap. The side panel can be formed of sheet metal and the engagement ridge can have a retention structure engagement leg bent laterally outwardly from the side panel raised cricket. An outer side wall can be bent from the retention structure engagement leg in the exterior direction, and an exterior wall can be bent laterally inwardly from the outer side wall. In a cross section of the engagement ridge, the retention structure engagement leg can be about 0.43 inches, the outer side wall can be about 1.25 inches, and the exterior wall can be about 0.65 inches. The open polygonal channel cap can engage the retention structure engagement leg, the outer side wall and the exterior wall.

The retention slot of the sill panel can include an interior slot member extending outwardly in the downhill direction from the inner sill flange. A slot end wall can extend in the exterior direction from the interior slot member, and an exterior slot member can extend inwardly in the uphill direction. The exterior slot member of the retention slot of the sill panel can have a bent portion for resiliently gripping the window panel. The sill panel can be formed of sheet metal.

A panel joining component can be included for joining two window panels together, having an uphill panel slot and a downhill panel slot. The panel joining component can be formed of a single piece of sheet metal bent into a generally H shaped cross section for forming the uphill and downhill panel slots. The uphill panel slot can have opposing walls with two layers of sheet metal, and the downhill panel slot can have opposing walls with a single layer of sheet metal. The downhill slot can have an exterior wall having a bent edge for resiliently gripping a respective window panel.

The present invention can also provide an open polygonal elongate channel cap formed of sheet metal for securing a window panel to a side panel. The channel cap can have a cross section including a laterally inwardly extending side panel engagement leg forming an outer edge for engaging an engagement ridge of the side panel. An outer side wall can extend in an exterior direction from the side panel engagement leg. An exterior connecting wall can extend laterally inwardly from the outer side wall. An inner side wall can extend in the interior direction from the exterior connecting wall and terminate in an outwardly angled window panel engagement leg forming an inner edge and extending in an angled direction towards the outer side wall and the exterior connecting wall, for engaging the window panel. Respective bent corners can be between the side panel engagement leg and the outer side wall, between the outer side wall and the exterior connecting wall, between the exterior connecting wall and the inner side wall, and between the inner side wall and the window panel engagement leg.

In particular embodiments, there can be an opening between the outer edge and the inner edge. In the cross section, the side panel engagement leg can be shorter than the exterior connecting wall, the inner side wall can be shorter than the outer side wall, and the window panel engagement leg can be shorter than the exterior connecting wall. In the cross section of the channel cap, the side panel engagement leg can be about 0.33 inches, the outer side wall can be about 1.3 inches, the exterior connecting wall can be about 0.95 inches, the inner side wall can be about 0.8 inches, and the window panel engagement leg can be about 0.25 inches.

The present invention can also provide a method of securing a roof or window panel with a securement system including securing and sealing a first side of the roof or window panel with a first side structure having a first side panel with an outer side flange for interfacing with roofing or siding. A raised cricket can extend inwardly from the outer side flange for directing water away from the first side of the roof or window panel. An engagement ridge can extend from an inner edge of the cricket for engaging a retention structure extending along the first side of the roof or window panel. An open polygonal channel cap having an outer edge and an inner edge, can engage at least one of the engagement ridge of the first side panel cricket and the retention structure with the outer edge, and engage the roof or window panel with the inner edge, the cap resiliently snapping in place and providing waterproofing and rigidity to the first side structure.

In particular embodiments, an upper edge of the roof or window panel can be secured and sealed with a header panel. The header panel can have an outer header flange for interfacing with roofing or siding. A raised cricket can extend inwardly from the outer header flange for directing water away from the upper end of the roof or window panel. The cricket can have a slot for accepting and trapping the upper edge of the roof or window panel. An inner header flange can extend inwardly from the cricket below the slot for securement to the roof or side of a structure. A second side of the roof or window panel can be secured and sealed with a second side structure. A lower edge of the roof or window panel can be secured and sealed with a sill panel. The sill panel can have an outer sill flange for interfacing with roofing or siding. An inner sill flange can extend inwardly from the outer sill flange for securement to the roof or side of the structure. A retention slot can extend outwardly from the inner sill flange over at least a portion of the inner sill flange for receiving and trapping the lower edge of the roof or window panel. The header panel, side panels, caps and sill panel can be formed from sheet metal. The retention structure can include at least one anchor member. The at least one anchor member can be secured to the first side of the roof or window panel. A structure along the first side of the roof or window panel can be engaged with the at least one anchor member.

The header panel slot can have an exterior slot member and an interior slot member. The exterior slot member can include a first portion extending in a downhill direction from the raised cricket in a spaced relationship to the interior slot member. A second portion can extend from the first portion towards the interior slot member for trapping the window panel between the second portion of the exterior slot member and the interior slot member. The header panel slot can be formed of sheet metal extending inwardly in the downhill direction from the raised cricket and bent to provide the first and second portions of the exterior slot member with two layers of sheet metal, and the interior slot member with one layer of sheet metal. The sheet metal forming the first portion of the exterior slot member can extend inwardly in the downhill direction from the raised cricket generally parallel to the interior slot member and can be bent from the first portion and extend towards the interior member to form the second portion of the slot member, and can be bent against and extend along the second portion and the first portion of the exterior slot member to form the second and first portions with a double sheet metal layer, and can be bent from the first portion of the exterior slot member towards the interior slot member to form an uphill member of the header panel slot, and can be bent inwardly in the downhill direction from the uphill member to form the interior slot member. At least a portion of at least one slot member can be capable of resilient deflection for gripping the window panel. The first portion of the exterior slot member can extend in a downhill direction from the raised cricket at least about 1 inch and the second portion can extend from the first portion about 1.2 inches.

The open polygonal channel cap can be elongate and can have a cross section with a laterally inwardly extending side panel engagement leg forming the outer edge for engaging the engagement ridge of the first side panel. An outer side wall can extend in an exterior direction from the side panel engagement leg. An exterior connecting wall can extend laterally inwardly from the outer side wall. An inner side wall can extend in the interior direction from the exterior connecting wall and terminate in an outwardly angled window panel engagement leg forming the inner edge that extends in an angled direction towards the outer side wall and the exterior connecting wall. In the cross section of the open polygonal channel cap, the side panel engagement leg can be shorter than the exterior connecting wall, the inner side wall can be shorter than the outer side wall, and the window panel engagement leg can be shorter than the exterior connecting wall. The open polygonal channel cap can be formed of sheet metal, with respective bent corners between the side panel engagement leg and the outer side wall, between the outer side wall and the exterior connecting wall, between the exterior connecting wall and the inner side wall, and between inner side wall and the window panel engagement leg. In the cross section of the open polygonal channel cap, the side panel engagement leg can be about 0.33 inches, the outer side wall can be about 1.3 inches, the exterior connecting wall can be about 0.95 inches, the inner side wall can be about 0.8 inches, and the window panel engagement leg can be about 0.25 inches. The open polygonal channel cap can have a cross section including a perimeter with 5 sides with an opening between the outer edge and the inner edge.

The engagement ridge of the side panel can extend laterally outwardly from the raised side panel cricket and can be generally channel shaped for engaging the open polygonal channel cap. The side panel can be formed of sheet metal and the engagement ridge can have the retention structure engagement leg which can be bent laterally outwardly from the side panel raised cricket. An outer side wall can be bent from the retention structure engagement leg in the exterior direction, and an exterior wall can be bent laterally inwardly from the outer side wall. In the cross-section of the engagement ridge, the retention structure engagement leg can be about 0.43 inches, the outer side wall can be about 1.25 inches and the exterior wall can be about 0.65 inches. The open polygonal channel cap can engage the retention structure engagement leg, the outer side wall and the exterior wall.

The retention slot of the sill panel can include an interior slot member extending outwardly in the downhill direction from the inner sill flange. A slot end wall can extend in the exterior direction from the interior slot member, and an exterior slot member can extend inwardly in the uphill direction. The exterior slot member of the retention slot of the sill panel can have a bent portion for resiliently gripping the window panel. The sill panel can be formed of sheet metal.

A panel joining component can join two window panels together and can have an uphill panel slot and a downhill panel slot. The panel joining component can be formed of a single piece of sheet metal bent into a generally H shaped cross section for forming the uphill and downhill panel slots, with the uphill panel slot having opposing walls with two layers of sheet metal, and the downhill panel slot having opposing walls with a single layer of sheet metal. The downhill slot can have an exterior wall having an bent edge for resiliently gripping a respective window panel.

The present invention can also provide a method of securing a window panel to a side panel with an open polygonal elongate channel cap formed of sheet metal. The channel cap can have a cross section including a laterally inwardly extending side panel engagement leg forming an outer edge for engaging an engagement ridge of the side panel. An outer side wall can extend in an exterior direction from the side panel engagement leg. An exterior connecting wall can extend laterally inwardly from the outer side wall. An inner side wall can extend in the interior direction from the exterior connecting wall and terminate in an outwardly angled window panel engagement leg forming an inner edge and extending in an angled direction towards the outer side wall and the exterior connecting wall, for engaging the window panel. The channel cap can have respective bent corners between the side panel engagement leg and the outer side wall, between the outer side wall and the exterior connecting wall, between the exterior connecting wall and the inner side wall, and between the inner side wall and the window panel engagement leg.

In particular embodiments, there can be an opening between the outer edge and the inner edge. In the cross section, the side panel engagement leg can be shorter than the exterior connecting wall, the inner side wall can be shorter than the outer side wall, and the window panel engagement leg can be shorter than the exterior connecting wall. In the cross-section of the channel cap, the side panel engagement leg can be about 0.33 inches, the outer side wall can be about 1.3 inches, the exterior connecting wall can be about 0.95 inches, the inner side wall can be about 0.8 inches and the window panel engagement leg can be about 0.25 inches.

The present invention can provide a roof or window panel to metal roofing interface securement system that facilitates the integration of a roof or window panel system into new or pre-existing construction. The system can be comprised of components which can be specifically designed and fabricated to integrate the roof or window panel system into most or all currently available metal roofing or siding systems. The system can have watertight integrity with specific consideration for the existing environment in which the system is installed. The system can have a minimum number of components, to insure simple and reliable field installation by metal roofing or siding contractors utilizing standard tools and practices. The system can be compatible with or manufactured from existing roofing or siding materials to comply with roof system manufacturers warranties. The system can be aesthetically compatible with most or all associated building components.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

A description of example embodiments of the invention follows.

The perimeter of commercially available roof or window panels often provides no obvious means of integration with or to any existing metal roof system. One example of such a roof or window panel can be an extruded plastic honey comb polycarbonate panel, such as a Lexapanel™ panel made by Sabic Innovative Plastics.

With regard to the securement of the sides of the roof or window panel, in the present invention system, an extremely complex shape can be used to actively engage the profiles of the roof or window panel on the sides for securement to a roof or siding. Also, a simplified profile utilizing a snap or "friction engaged" batten or open polygonal channel cap can provide securement and allow thermal movement, provide a water tight seal and serve as a double structural element along the sides of the panels.

Figure 1:
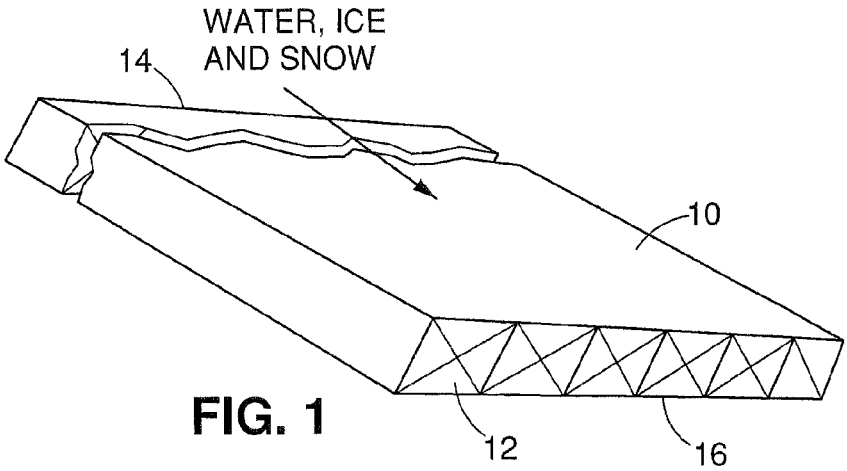
FIG. 1 is a schematic perspective view of a representation of a roof or window panel.

Referring to FIG. 1, some roof or window panels 10 can be extruded from plastic and can be at an average of 20 mm thickness and can be longitudinally honeycombed 12 so the top 14 and bottom 16 ends are not sealed, and therefore must be provided with some means of protection from water, ice and snow.

With regard to the top or upper end of the roof of window panel, in the present invention system, a header profile can be used to both protect and anchor the top, upper, upstream, uphill end or edge 14 of the roof or window panel 10 while also providing a means to attach various roofing or siding profiles as needed. The header can have a flat "s" or reverse bend 32 for roof interface, a cricket or raised portion for directing water of minimum height, and encapsulate the panel top 14 for weather protection. Thermal expansion and live movement from wind can be addressed or provided in this header profile.

Since the bottom 16 of the roof or window panels 10 can be open to the elements, a sill panel can be used for securement and sealing in the present invention. The water and ice from the area above the sill panel poses a significant difficulty. Closing the bottom end 16 without creating a potential dam situation is provided in the present invention with a robust design.

In the present invention, a sill flange of the sill panel can have a retention slot that can receive, trap and seal the bottom, downstream, downhill or lower end or edge 16 of the roof or window panel 10, and as load increases a gasket can be forced tighter creating "live active seal."

Figure 2:
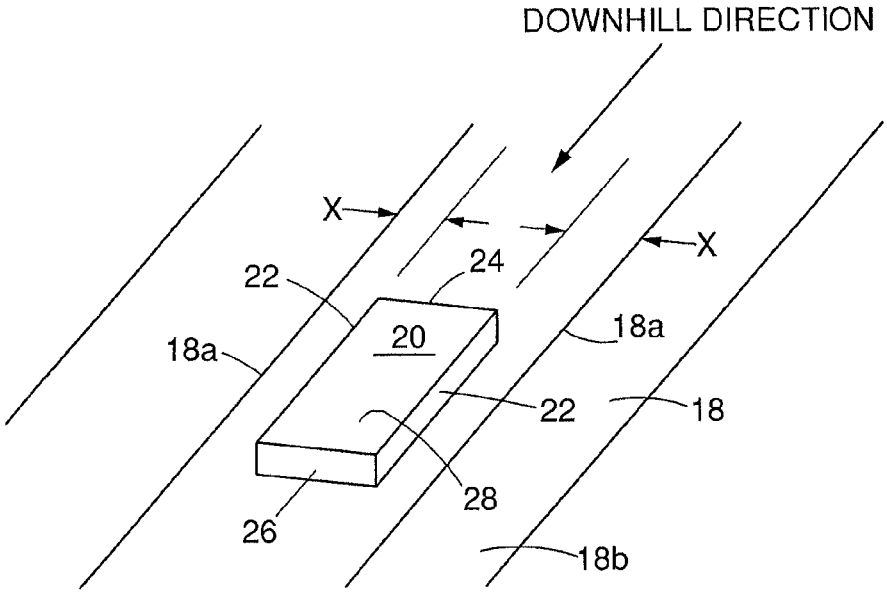
FIG. 2 is a schematic perspective view of a portion of a metal roof or siding with a roof or window panel interface securement system.

Referring to FIG. 2, with regard to egress and tolerances, the vast majority of metal roof or siding systems require for a roof 18 some distance between ribs, seams or joints 18*a* of the siding or roof panels, members, or elements 18*b* in order to properly drain water and to manipulate materials around any roof/wall penetrations or window assemblies 28.

X represents a minimum distance to provide adequate drainage for the area above the penetration. If the minimum distance X is not met, the penetration (skylight, etc.) typically forms a dam or pond on the roof. The present invention roof or window panel interface securement system 20 can provide enough materials around the sides 22, header or head 24 and sill 26 to create a roof panel interface, such as at a rib 18*a*, that is a distance X of at least 10 inches from the roof or window panel interface securement system 20 to prevent damming. The header can provide 6 to 8 inches clearance or extension in order to properly fasten to the roof.

Some embodiments of extruded plastic roof or window panels 10 can be made with a finished thickness of 20 mm but several thicknesses are possible. In one embodiment, the roof or window panels can be Lexapanel™ panels, but other types of roof or window panels can be used with the present invention, including flat and/or solid panels. Modifications to the interface profiles are easily accommodated and thicker or thinner roof or window panels will have no effect on system integrity. The present invention can have modified shapes and dimensions to accommodate different types of roof or window panels.

Various siding and roofing profiles currently exist and more are developed regularly. Virtually any seam or panel edge treatment can be incorporated into the "roof siding" section of the interface. The present invention can also be used with siding and roofing that is not metal. The installer can create custom "locks" or seams to integrate the present invention roof or window panel interface securement system 20 with various roofs and siding.

A vertical or upright "leg" can be incorporated at any location desired in the interface panel to join with roofing or siding, such as at a rib 18*a*.

Figure 3:
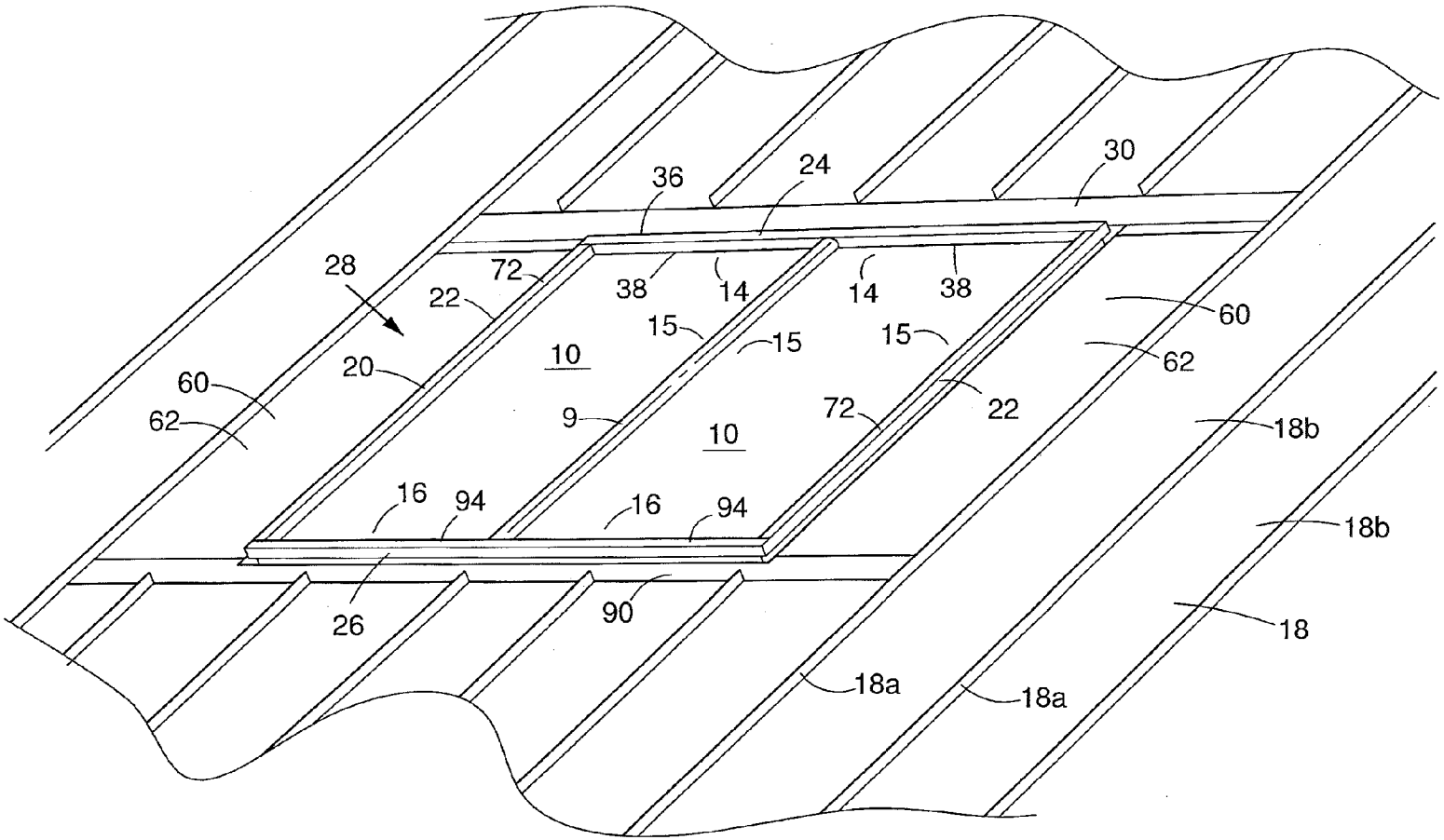
FIG. 3 is a perspective view of a roof window panel system mounted to a metal roof with an embodiment of the present invention interface securement system.
Figure 4:
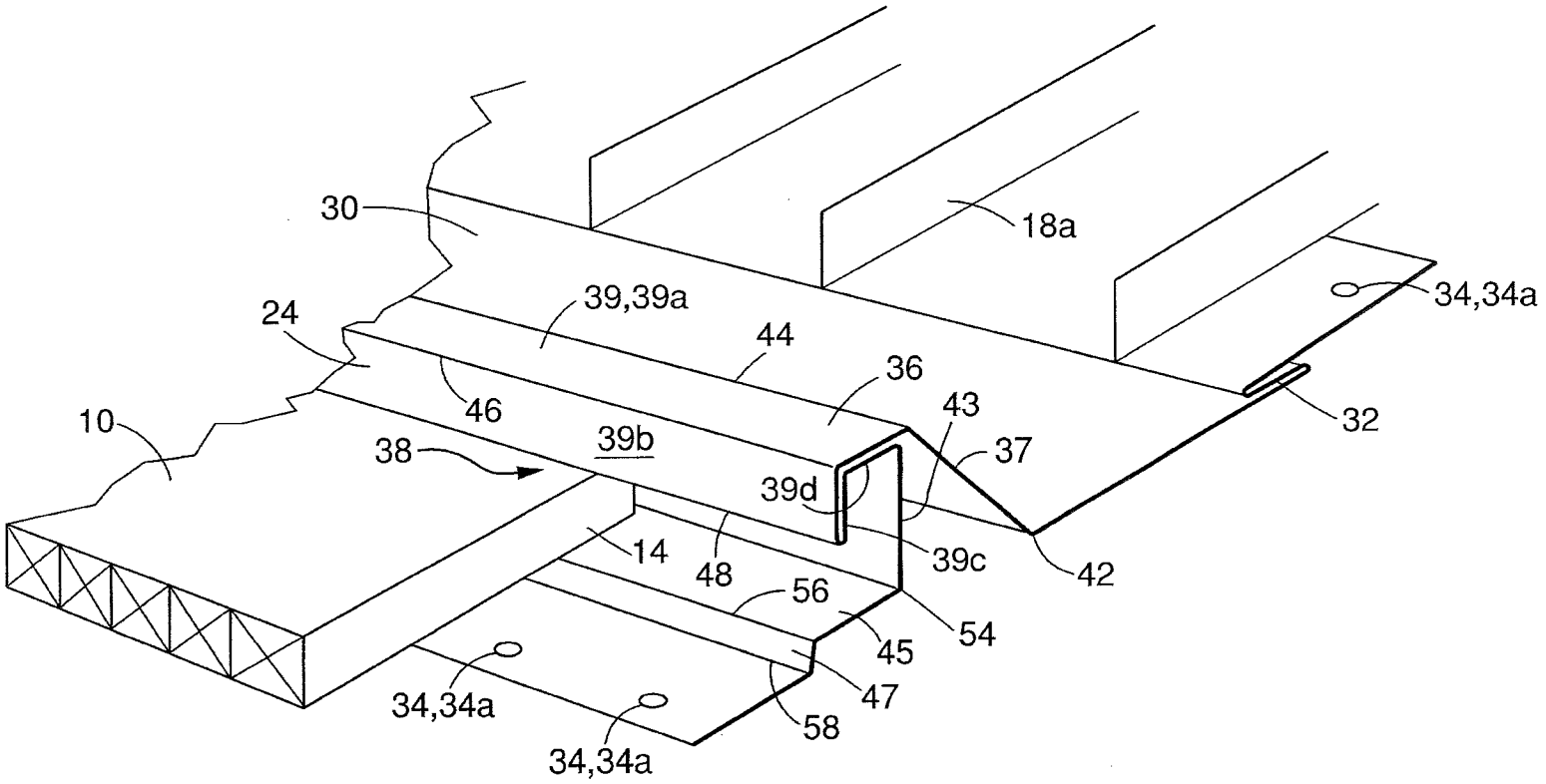
FIG. 4 is a perspective view of a portion of an embodiment of an interface header in the present invention securing a panel to a roof.
Figure 5:
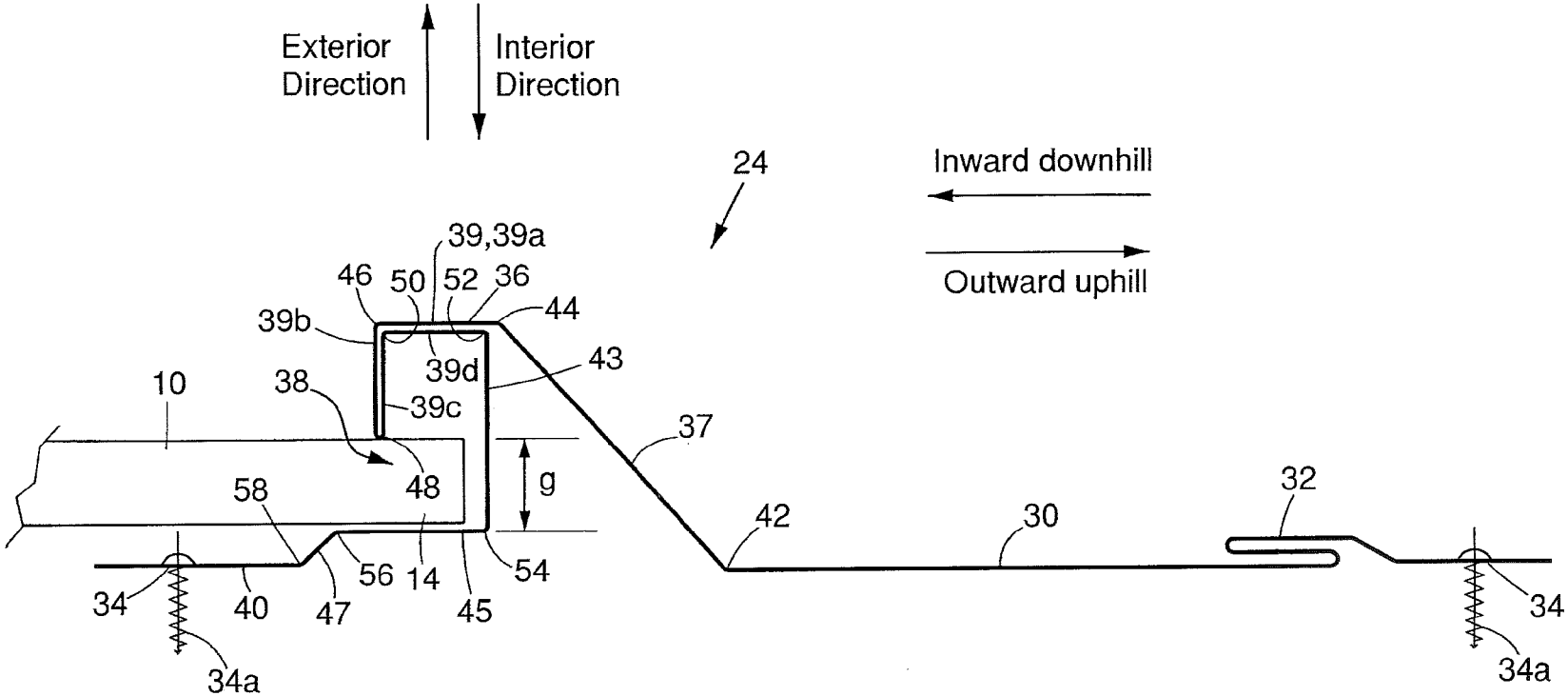
FIG. 5 is an end view of the embodiment of FIG. 4.
Figure 6:
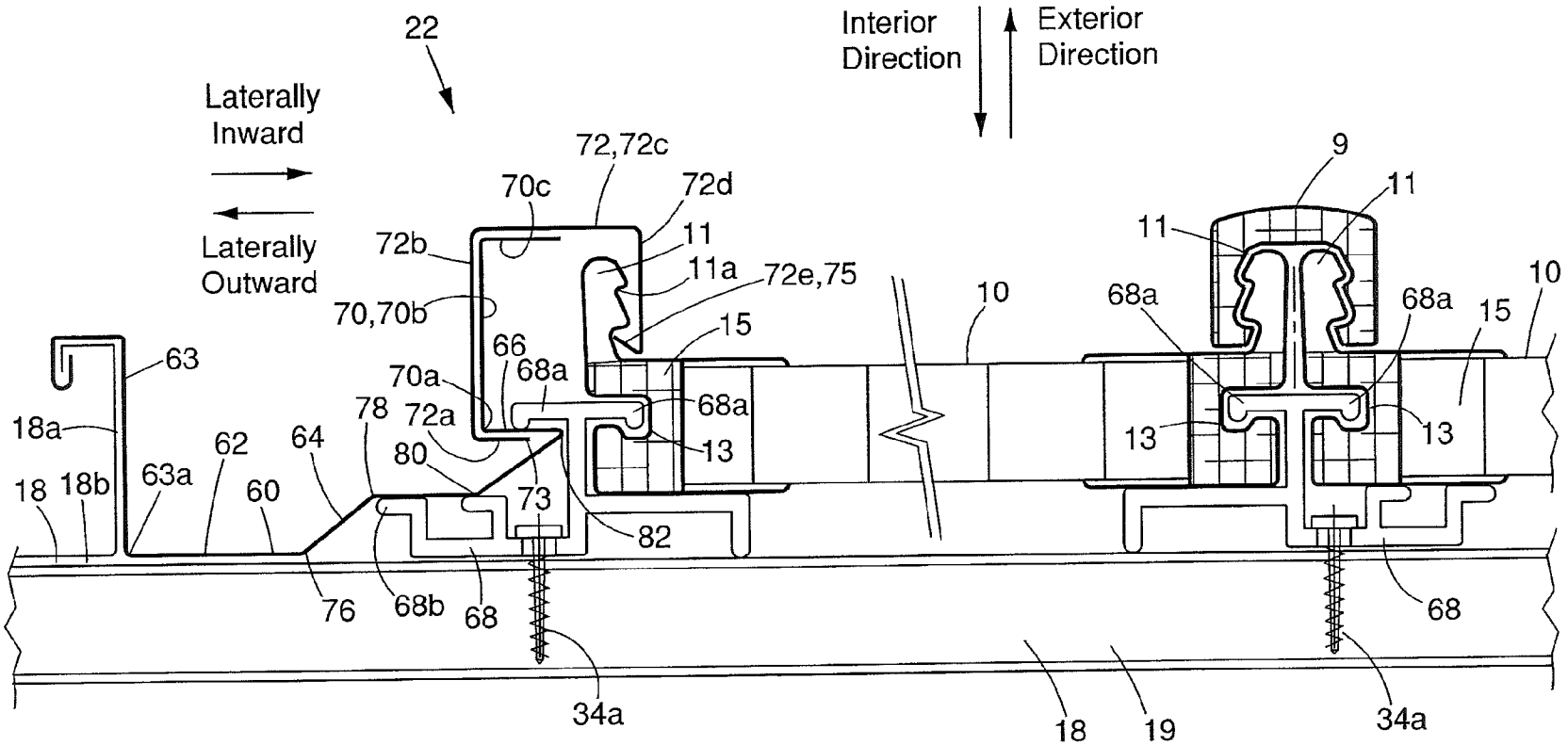
FIG. 6 is a cross-sectional view of a portion of one embodiment of a side structure having a side panel and cap in the present invention securing and sealing the side of one particular type of panel to a roof.

Referring to FIG. 3, one embodiment of the present invention interface securement system 20 for a roof or window panel 10 is shown securing two panels 10 of a window panel or glazing system to a metal roof 18, forming a window assembly 28. The roof or window panel 10 can be referred to as window panel 10 for both roof and siding applications. Window panels 10 can be secured to each other by a batten or locking cap 9 which engages ridges 11 on the sides 15 of the window panels 10, and by retention structures 68 having arms 68*a* inserted into slots 13 (FIG. 6). The retention structures 68 can be secured to structural elements 19 of the roof 18 by screws 34*a*. The securement system 20 can include a top, upper, upstream, uphill or header panel 24, two side structures 22 and a sill panel 26, for securing and sealing the panel 10 or glazing system to the roof 18. Referring to FIGS. 2, 4 and 5, the header panel 24 can be laterally elongate and can have a laterally elongate top, upper, upstream, uphill or outer header periphery flange 30, which can be interfaced with or inserted under the roofing 18, for securement with fasteners 34*a* through a series of holes 34 and can have a flat S or reverse bend 32. A laterally elongate raised portion or cricket 36 extending at the bottom or downhill side of the outer header flange 30 can direct water away from the upper end of the window panels 10. The cricket 36 can have a laterally elongate gripping, retention or trapping header panel slot 38 for accepting and trapping the upper edge 14 of the window panels 10 in a waterproof or sealed manner. A laterally elongate inner, bottom, downstream, downhill or lower header periphery flange 40 can extend downhill or inwardly from the cricket 36 or slot 38 and below the slot 38, for securement to the roof 18 with fasteners 34 such as screws or nails. The header panel 24 can be formed of sheet metal and can have a generally flat outer header flange 30. The cricket 36 can be bent upwardly, outwardly in the downhill or downstream exterior environment direction from the outer header flange 30, then bent back under the cricket 36 and below the cricket 36 to form the slot 38. The inner header flange 40 can be bent below the slot 38.

The header panel 24 can be formed of 24 gauge (0.024 inches thick) steel sheet metal which can provide strength and rigidity. The outer 30 and inner 40 header flanges can have a series of spaced apart holes 34 for securement to the roof 18. The outer header flange 30 can be generally flat, with a laterally elongate flat S or reverse bend 32 positioned below holes 34 near the uphill end of the outer header flange 30. The raised cricket 36 can have a laterally elongate rising portion 37 bent, curved or angled from the outer header flange 30, along a laterally elongate or extending fold line or bend 42, and extend in the inward or downhill direction, extending in a rising manner in the exterior environment direction away from the plane of the outer header flange 30, the window panel 10, and roof 18 or siding, which can be, for example, at a 45° angle. The header panel slot 38 can be formed between an exterior slot wall, structure, surface or member 39, and an interior slot, wall, structure, surface or member 45. The exterior slot member 39 can include a first laterally elongate portion 39*a* extending in an inwardly downhill or downstream direction from the raised cricket 36 and can be generally parallel to the outer 30 and inner 40 flanges, and the interior slot member 45. The first portion 39*a* can be bent from the rising portion 37 along a laterally elongate or extending fold line or bend 44. The exterior slot member 39 can have a laterally elongate or extending second portion 39*b* that is bent from the first portion 39*a* along a laterally elongate or extending fold line or bend 46 and extend towards the interior slot member 45 generally perpendicular to the outer flange 30, the window panel 10 and the interior slot member 45. The sheet metal forming the exterior slot member 39 can be bent along a laterally elongate or extending fold line or bend 48 to form a laterally elongate or extending contacting or sealing surface or edge that contacts and seals against the window panel 10. An additional laterally elongate or extending fold line or bend 50 can be made in the sheet metal to form second or double interior sheet metal layers 39*c* and 39*d* that extend along or against the second 39*b* and first 39*a* portions of the exterior slot member 39. The sheet metal can be bent along a laterally elongate or extending fold line or bend 52 to form a laterally elongate or extending uphill wall or member 43 of the header panel slot 38 extending from the first portion 39*a* of the exterior slot member 39 and then bent inwardly in the downhill direction from member 43 along a laterally elongate or extending fold line or bend 54 to form the interior slot member 45. The interior slot member 45 can be laterally elongate or extending and can be on a plane generally parallel to the planes of the outer 30 and inner 40 header flanges. The sheet metal can be bent from the interior slot member 45 along laterally elongate or extending fold lines or bends 56 and 58 to form a laterally elongate or extending transition portion 47 between the interior slot member 45 and the inner header flange 40.

The double sheet metal layer thickness of the exterior slot member 39 provides it with increased strength and rigidity. The slot gap g can be sized to be slightly smaller than the thickness of the window panel 10 inserted therein so that at least a portion of one of the first 39*a* and second 39*b* portions of the exterior slot member 39 and the interior slot member 45 can resiliently deflect for gripping the window panel 10. The first portion 39*a* can deflect in the exterior environment direction and the second portion 39*b* can deflect in the inward or downhill direction. The interior slot member 45 can deflect away from the exterior slot member 39. The resilient gripping of the window panel 10 by the header slot 38 and along the sealing surface 48 can create a seal on the window panel 10 that can move to compensate for thermal expansion or movement due to wind. In one embodiment, the first portion 39*a* of the exterior slot member 39 can extend in the downhill direction from the bend 44 of the raised cricket 36 at least about 1 inch, and the second portion 39*b* can extend from the first portion 39*a* by about 1.2 inches. This can provide the exterior slot member 39 with desired deflection properties for resiliently gripping the window panel 10. The exterior 39 and interior 45 slot members can be made to initially angle towards each other or be closer together, and can be expanded away from each other when the window panel 10 is inserted into the slot 38.

Referring to FIGS. 6-12, one embodiment of the side structures 22 is shown. Each side structure 22 can secure and seal the sides 15 of the window panels 10 and can include a side panel 60 having an outer side lateral periphery flange 62 for integrating or interfacing with roof panels 18*b*, which can include lateral insertion under the roofing 18*b* or securement to ribs 18*a*. The side panel 60 can be elongate in the uphill/downhill direction, and the uphill end of the side structure 22 or the outer side flange 62 can be inserted under the header panel 24. A raised portion or cricket 64 can extend laterally inwardly from the outer side flange 62 for directing water away from the outer sides 15 of the window panels 10. An elongate engagement ridge, edge, protrusion or structure 66 can extend along an inner edge of the cricket 64 for engaging a retention structure 68 extending or positioned along the sides of the window panels 10. In one embodiment, the retention structures 68 can be one or more anchor brackets, members or clips which can have an arm or protrusion 68*a* engaged or positioned within structures such as elongate slots 13 within the sides 15 of the panels 10, and are secured to structural elements 19 of the roof 18 with fasteners 34*a*, for securing the panels 10 to the roof 18. In other embodiments, various other retention structures can be mounted around or over the sides of the window panels 10. The engagement ridge 66 can engage underneath another surface, edge, structure, protrusion or arm 68*a* of the retention structures 68, for securement of the side panel 60 to the retention structure 68 and to the roof 18. This traps the side panel 60 between the retention structure 68 and the roof 18. The side panel 60 can be formed of sheet metal and can have a generally flat outer side flange 62. The cricket 64 can be bent upwardly from the outer side flange 62 and bent back onto itself laterally outwardly to form the engagement ridge 66. The sheet metal can be bent vertically up from the engagement ridge 66 and then bent laterally inwardly to form a channel structure 70 with an upper ridge or leg 70*c* for an open polygonal channel batten cap 72 to engage around.

The open polygonal channel batten cap 72 can have an outer edge 73 formed by a side panel engagement wall or leg 72*a* (FIGS. 6 and 10-12) which can engage an underside surface of the engagement ridge 66 of the side panel 60 and can trap and secure the engagement ridge 66 against the underside of the arm 68*a* of the retention structure 68 to lock in place in a sandwiched manner. An inner edge 75 of the cap 72 formed by a window panel engagement wall or leg 72*e* can engage an upper surface of the window panel 10 and can be resiliently snapped in place around the upper ridge 11 of the window panel 10. The cap 72 with its polygonal channel shape with the opening facing down, can provide water proofing, elongate rigidity and securement to the connection between the window panels 10 and the side panels 60 of the side structure 22. The snap fit of the cap 72 can allow quick and easy installation while at the same time rigidly securing the window panels 10 to the side panel 60 to the retention structure 68 and to the roof 18. Some window panels 10 can have an upwardly extending elongate ridge 11 with elongate ridge members or notches 11*a* for securement to the inner edge 75 of the cap 72. The channel cap 72 can be formed of sheet metal and can have a generally interior or downwardly facing asymetrical channel, with a lateral top or exterior connecting cover wall 72*c*, a vertical outer leg or outer side wall 72*b*, and a vertical inner leg or inner side wall 72*d* bent and extending downwardly towards the interior from opposite sides of the top or exterior connecting wall 72*c*. The outer edge 73 can be bent laterally inwardly into the channel from the outer leg 72*b*, and the inner edge 75 can be bent at an angle upwardly inwardly into the channel from the inner leg or side wall 72*d*. In some embodiments, flat window panels 10 can be used, and the engagement ridge 66, channel cap 72 and retention structure 68 can be configured appropriately.

Figure 11:
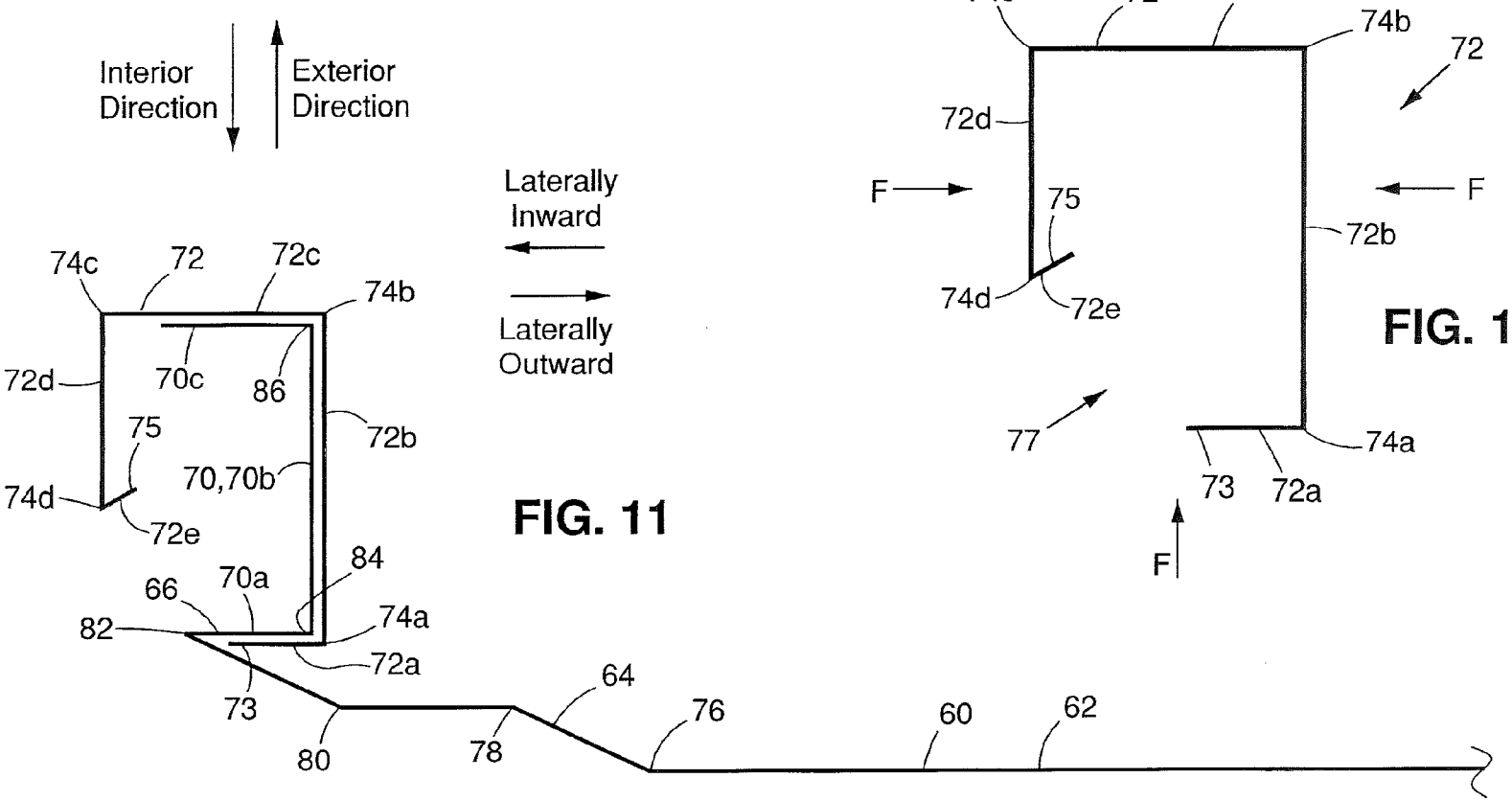
Figure 13:
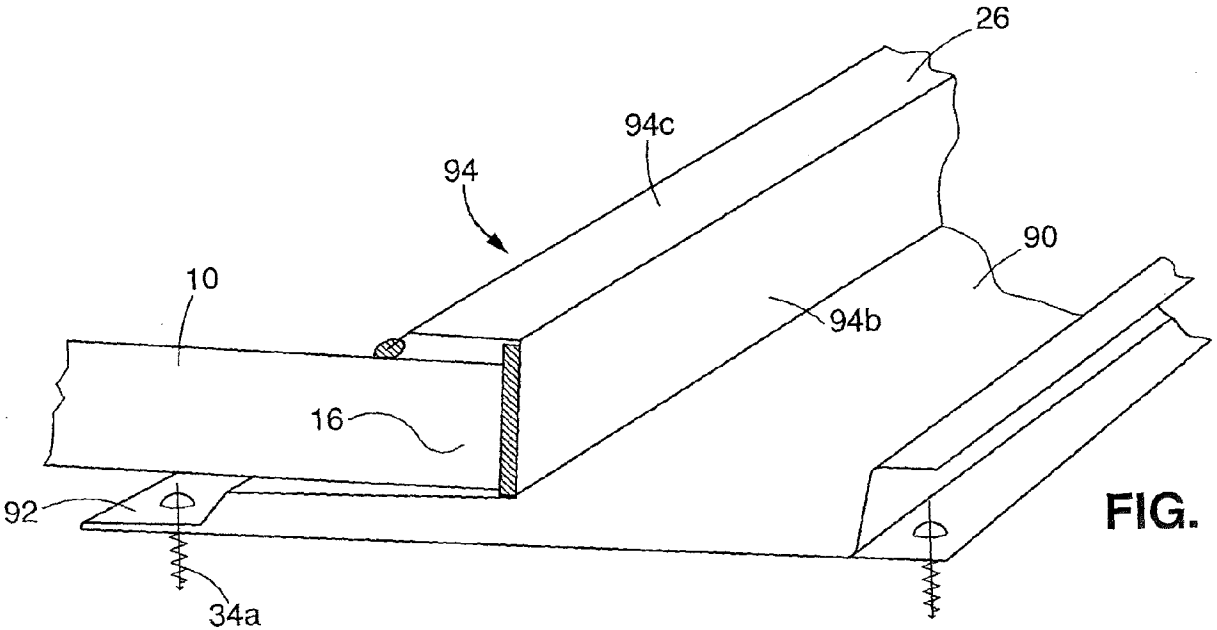
FIGS. 13 and 14 are perspective views of a portion of an embodiment of a sill panel engaged with a panel.
Figure 14:
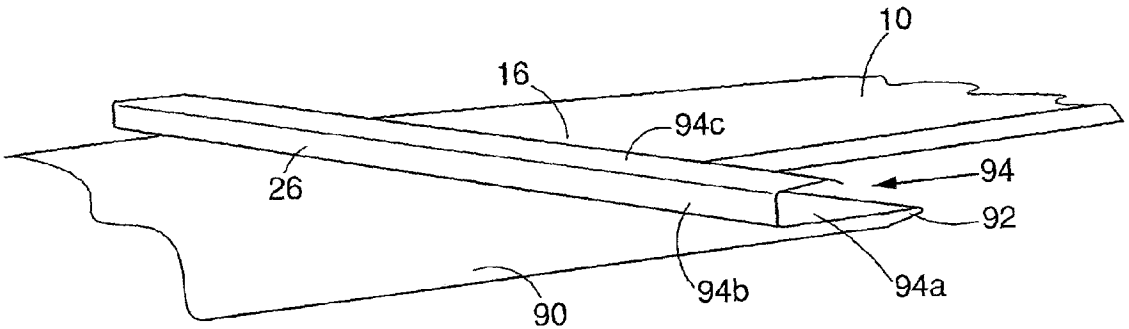
Figure 15:
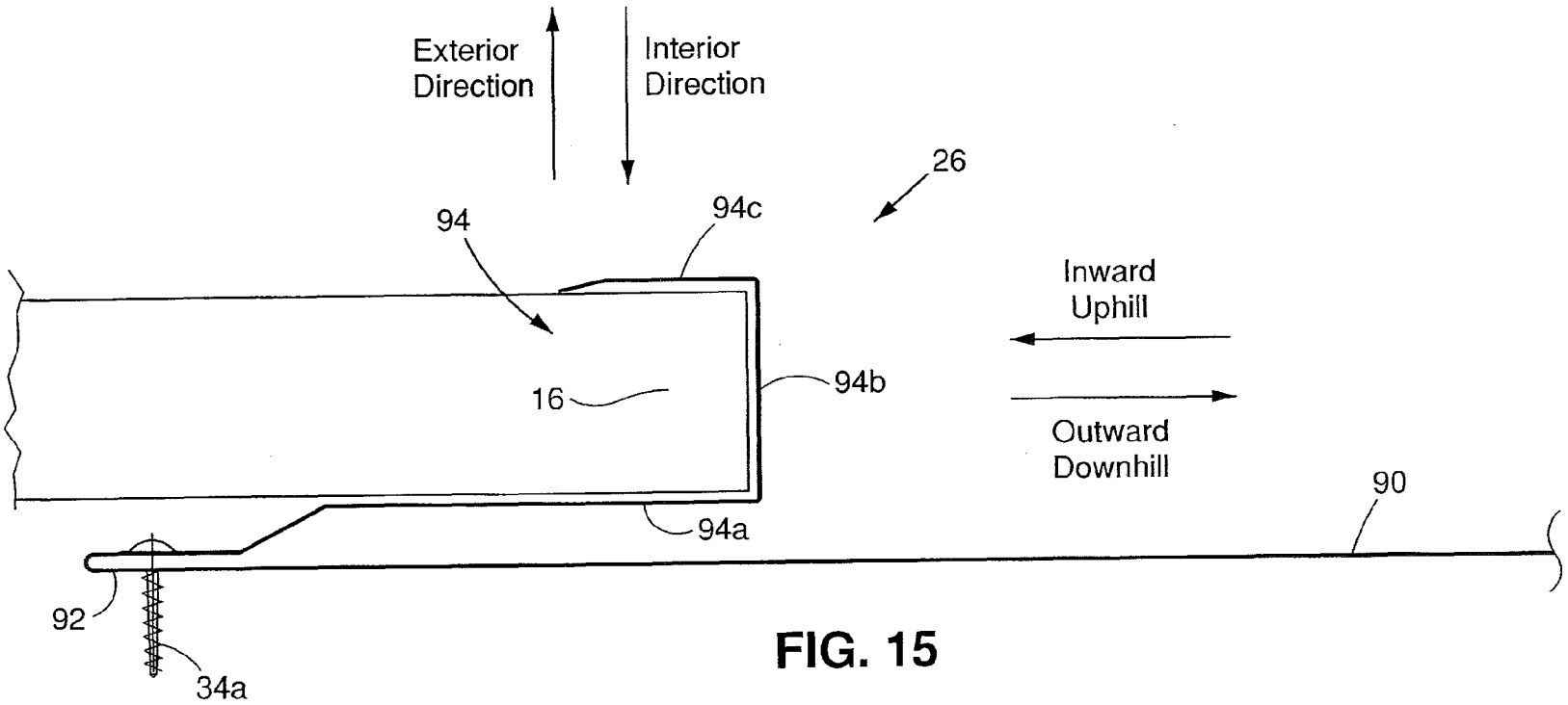
FIG. 15 is an end view of an embodiment of a sill panel.
Figure 16:
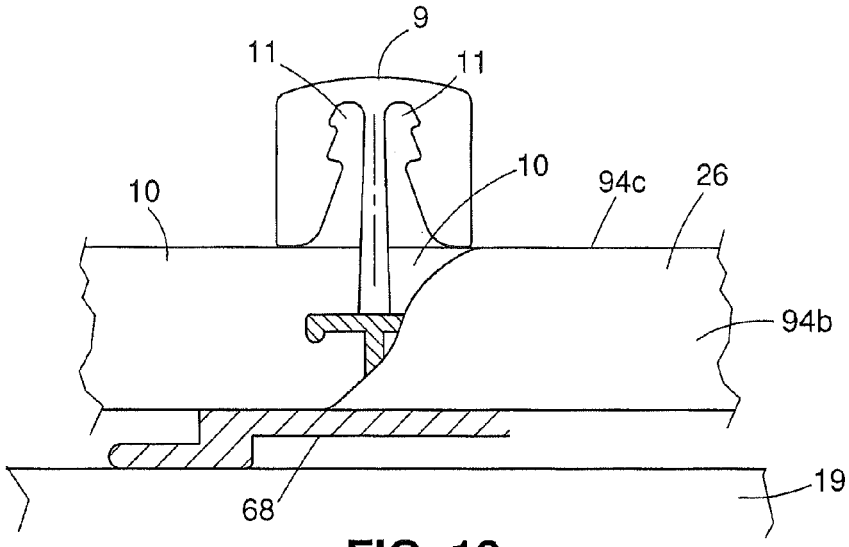
FIG. 16 is a broken away view of a portion of a sill panel at the joint between two roof or window panels.

The side panel 60 of each side structure 22 can be formed of 24 gauge steel sheet metal and can have an uphill/downhill extending upright rib member 63 bent along a fold line or bend 63*a* from the outer side flange 62 to be at the outer side periphery. The rib member 63 can be positioned from the channel cap 72 by about or more than the distance X (FIG. 8) for securement to ribs 18*a* of the roof panels 18*b*, such as by bending ends of the ribs 18*a* and 63 together to form a sealed joint or seam. The raised cricket 64 can be formed by bending the sheet metal along one or more elongate fold lines or bends 76, 78 and 80 to rise into the exterior environment direction. The raised cricket 64 can have an angled step as shown in FIG. 6, which can provide rigidity and can engage a portion of the retention structure 68 for further strength. The engagement ridge 66 can be formed by bending the sheet metal along an elongate fold line or bend 82 at the inner edge of the cricket 64, and extending laterally outwardly. The bend 82 can be at an angle to form a structural corner for the engagement ridge 66, for providing strength and rigidity, for example, about 30 degrees relative to the cricket 64, where a portion of the cricket having bend 82 can be trapped between arm 68*a* and legs 68*b* of the retention structure 68 for interlocking. The engagement ridge 66 can be bent into a channel shaped structure 70 for engaging the channel cap 72 and can have a retention structure engagement wall or leg 70*a* bent laterally outwardly from the cricket 64, an outer side wall or leg 70*b* bent along elongate fold line or bend 84 from leg 70*a* in the exterior direction, and an exterior wall or leg 70*c* bent laterally inwardly from wall 70*b* along elongate fold line or bend 86 (FIG. 11). The walls 70*a*, 70*b* and 70*c* can be engaged by respective walls 72*a*, 72*b* and 72*c* of the channel cap 72 to form a double layer sheet metal structural element or portion which is channel shaped and provides increased strength and rigidity to the side structures 22 extending along the sides 15 of the window panels 10, for keeping the window panels 10 rigidly secured in place to resist forces from wind, rain, ice and snow. In some embodiments, the engagement ridge 66 can have a cross section where the retention structure engagement leg 70*a* is about 0.43 inches long, the outer side wall 70*b* is about 1.25 inches long, and the exterior wall 70*c* is about 0.65 inches long. By having the outer side wall 70*b* a longer or taller wall than walls 70*a* and 70*c*, and extending in the exterior environment direction, the channel shaped structure 70 can form a structural beam that has strength and rigidity in the interior/exterior directions.

The open polygonal channel cap 72 can be formed of 24 gauge steel sheet metal and can have an elongate length, for example 10 feet with elongate walls 72*a*-72*e*. The channel cap 72 can have a cross section with a laterally inwardly extending side panel engagement wall or leg 72*a* forming the ridge, protrusion or outer edge 73, with an outer side wall or leg 72*b* extending in an exterior direction from the side panel engagement leg 72*a*. An exterior connecting wall or leg 72*c* can extend laterally inwardly from the outer side wall 72*b*. An inner side wall or leg 72*d* can extend in the interior direction from the exterior connecting wall 72*c* and terminate in an outwardly angled window panel engagement wall or leg 72*e*, which forms the inner ridge, protrusion or edge 75. The window panel engagement leg 72*e* can extend in an angled direction into the interior of the channel cap 72 towards the outer side wall 72*b* and the exterior connecting wall 72*c*, for example, about 60° relative to inner side wall 72*d*. The channel cap 72 can have elongate fold lines, bends or bent corners, 74*a* between the side panel engagement leg 72*a* and the outer side wall 72*b*, 74*b* between the outer side wall 72*b* and the exterior connecting wall 72*c*, 74*c* between the exterior connecting wall 72*c* and the inner side wall 72*d*, and 74*d* between the inner side wall 72*d* and the window panel engagement leg 72*e*. An elongate opening can extend between outer edge 73 and inner edge 75 at a location diagonally from corner 74*b*. In the cross section of the channel cap 72, the side panel engagement leg 72*a* can be shorter than the exterior connecting wall 72*c*, the inner side wall 72*d* can be shorter than the outer side wall 72*b*, and the window panel engagement leg 72*e* can be shorter than the exterior connecting wall 72*c*. In one embodiment, in the cross section of channel cap 72, the side panel engagement leg 72*a* can be about 0.33 inches long, the outer side wall 72*b* can be about 1.3 inches long, the exterior connecting wall 72*c* can be about 0.95 inches long, the inner side wall 72*d* can be about 0.8 inches long, and the window panel engagement leg 72*e* can be about 0.25 inches long. When looking at the channel cap 72 along its length, these dimensions can be considered widths of the walls. The cross section of the channel cap 72 can be described as being asymmetrical with different length side walls 72*b* and 72*d* extending from opposite sides of the connecting wall 72*c*, which have respective ridges, protrusions or edges 73 and 75 extending into the interior of the channel.

Figure 7:
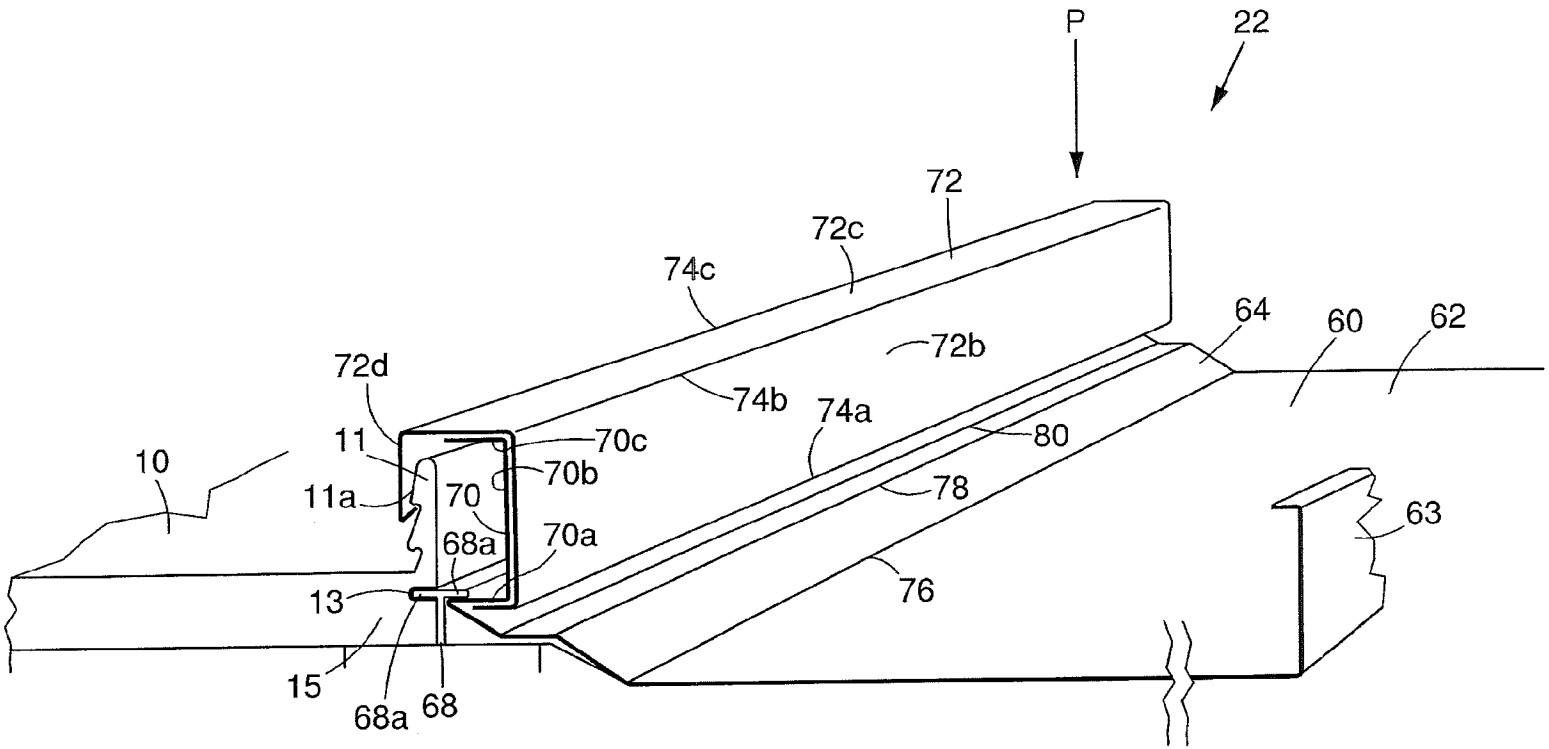
FIG. 7 is a perspective view of a portion of an embodiment of a side structure in the present invention.
Figure 8:
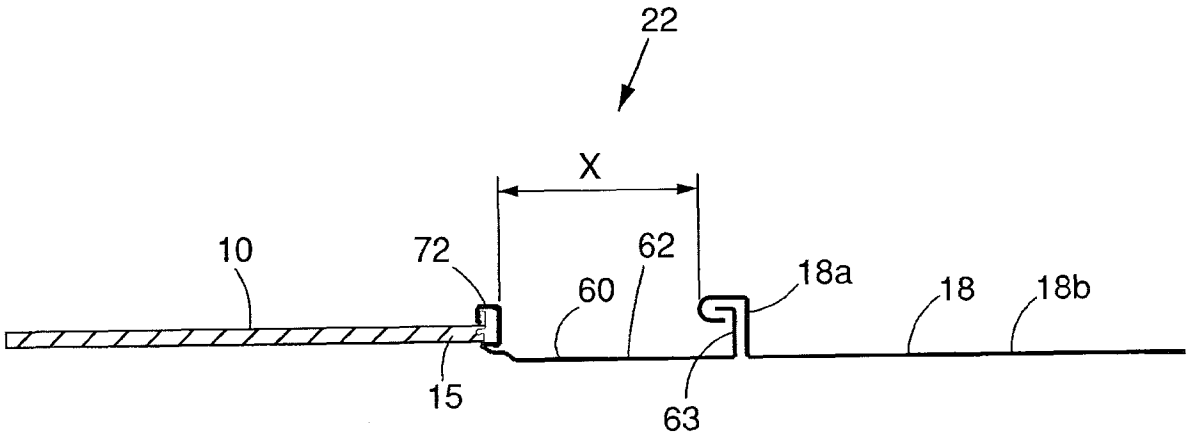
FIGS. 8-11 are end views of embodiments of the side structure.
Figure 9:
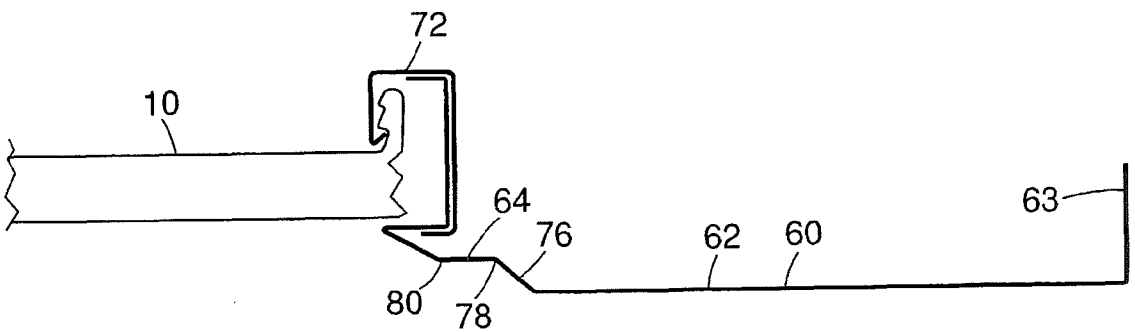
Figure 10:
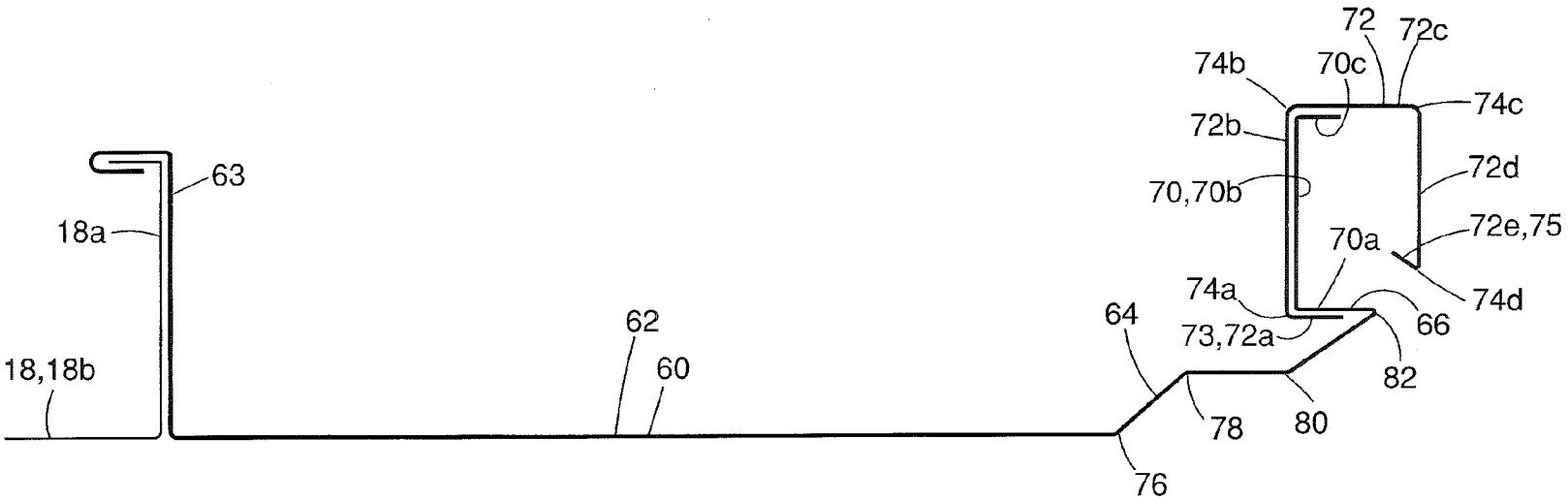
Figure 12:
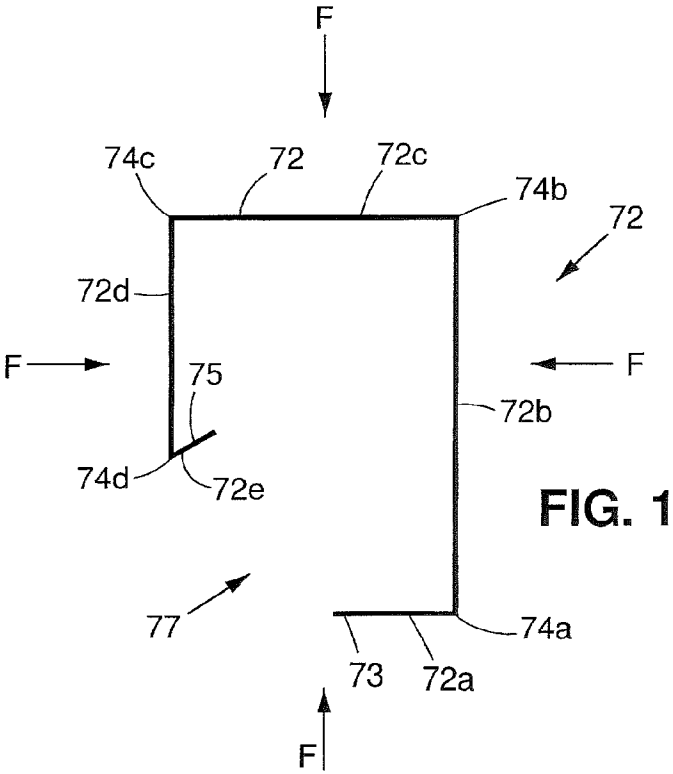
FIG. 12 is an end view of an embodiment of a channel cap.

Referring to FIGS. 6, 7 and 12, when installing the channel cap 72 in place, the channel cap 72 can be set over the engagement ridge 66 of the side panel 10 and the ridge 11 of the window panel 10. One end of the channel cap 72 can be pressed by hand or by rubber mallet, pressing or applying pressure P (FIG. 7). As pressure P is applied, the outer edge 73 and the side panel engagement leg 72*a* of the channel cap 72 is pushed down or against along the wall 70*b* of the engagement ridge 66, and the inner edge 75 and the angled window panel engagement leg 72*e* is pushed down across the top and along the side of the ridge 11 of the window panel 10. This deflects the walls 72*b* and 72*d* outwardly away from each other. The angle of the window panel engagement leg 72*e* facilitates the downward movement and allows passage over the tip of ridge 11. Movement continues until the side panel engagement leg 72*a* of channel cap 72 snaps around and engages the leg 70*a* of the engagement ridge 66, and the window panel engagement leg 72*e* engages a notch 11*a* of ridge 11, snapping in place. As the end of channel cap 72 is snapped in place, the pressure P can be progressively applied along the length of the channel cap 72 to progressively snap the elongate lengths of the legs 72*a* and 72*e* with the leg 70*a* of engagement ridge 66 and notch 11*a*, until completely snapped in place. This can provide a secure attachment without the use of fasteners or adhesives. The dimensions of the mating engagement ridge 66 and the channel cap 72 are selected so that when the channel cap 72 is snapped into place, some or all of the legs or walls 72*a*-72*e* are still deflected relative to each other or outwardly relative to each other, which can exert inward compressive forces F from the lateral and interior/exterior directions, as shown in FIG. 12. The channel cap 72 not only squeezes the window panel 10, the engagement ridge 66 of the side panel 60, and the retention structures 68 together with it, but in combination with the channel shaped structure 70, collectively forms a composite structural element along the side of the window panel 10 for providing increased rigidity. The channel shaped structure 70 when combined with the channel cap 72, can be described as having or being a 3-sided channel shape, or being a channel from 3 different sides. By using 24 gauge steel, once snapped in place, the channel cap 72 typically cannot be removed, except by destroying or damaging it.

Referring to FIGS. 13-16, the sill panel 26 in one embodiment, can be laterally elongate and have an outer, lower, downstream or downhill outer sill flange 90 for positioning under the side structures 22 and interfacing with or positioning over roofing 18*b*. An inner sill flange 92 can extend inwardly, upstream, upwardly or uphill from the outer sill flange 90 for securement to the roof 18 with fasteners 34*a*. An uphill facing elongate retention slot 94 can extend above and outwardly in the exterior direction or downhill from the inner sill flange 92 over at least a portion of the inner sill flange 92 for receiving, trapping, gripping and sealing a lower edge 16 of the window panel 10. The retention slot 94 can be sealed with a gasket or sealant for water proofing purposes. The sill panel 26 can be formed of 24 gauge steel sheet metal and can have a generally flat outer sill flange 90. The inner sill flange 92 can be at the uphill end of, or from, the outer flange. The retention slot 94 can be formed by bending the sheet metal back over itself or over and downhill above in the exterior direction at least a portion of the inner flange 92 to form an interior slot member 94*a*, then bent vertically upwardly or in the exterior direction to form a slot end wall 94*b* and laterally uphill to form an exterior slot member 94*c*. The exterior slot member 94*c* can have a seal with the window panel 10 and can compensate for movement.

Figure 21:
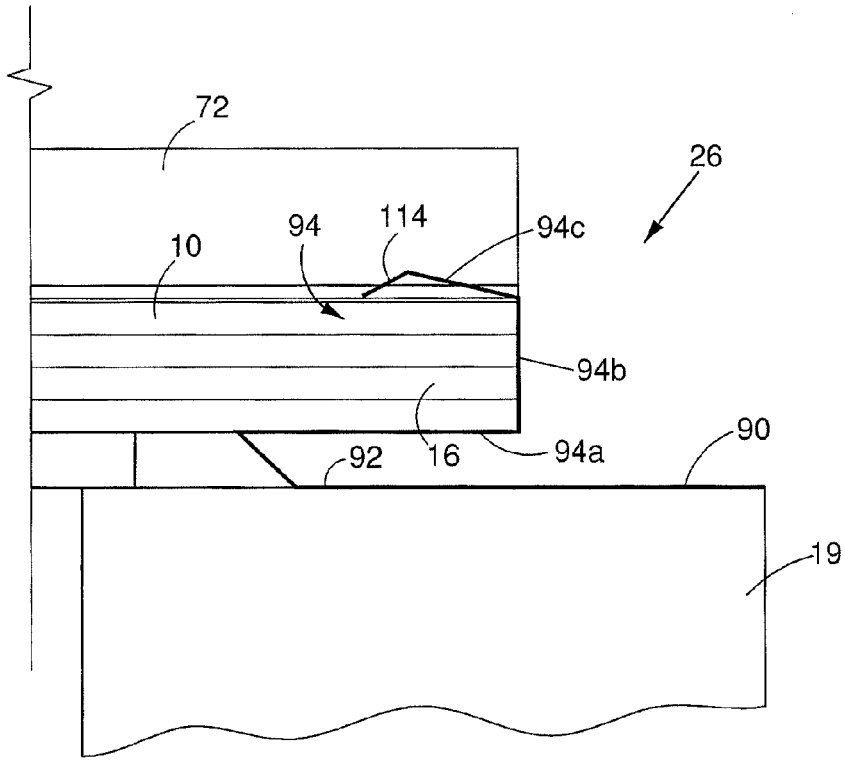
FIG. 21 is an enlarged sectional view of an embodiment of a sill panel gripping a window panel.
Figure 17:
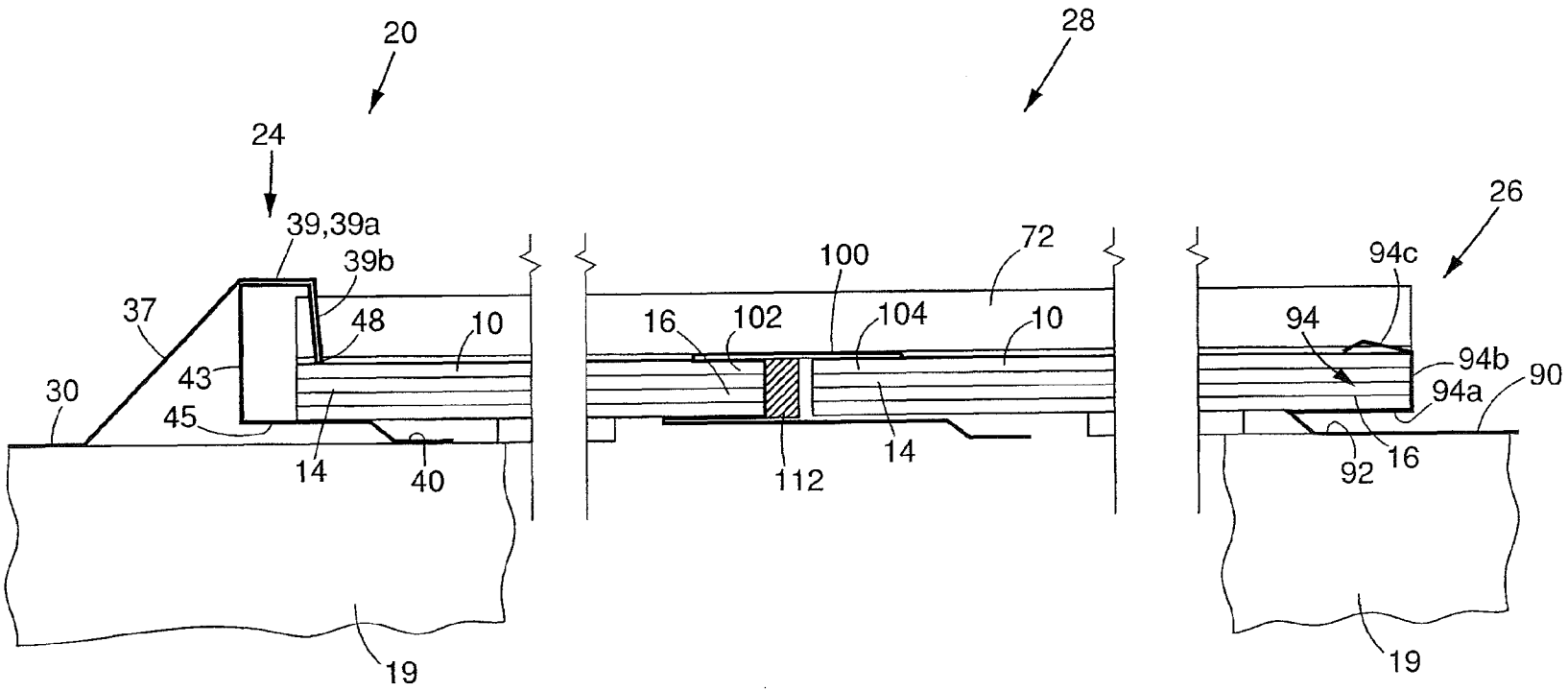
FIG. 17 is a side sectional view of another embodiment of the present invention interface securement system securing and sealing window panels.
Figure 18:
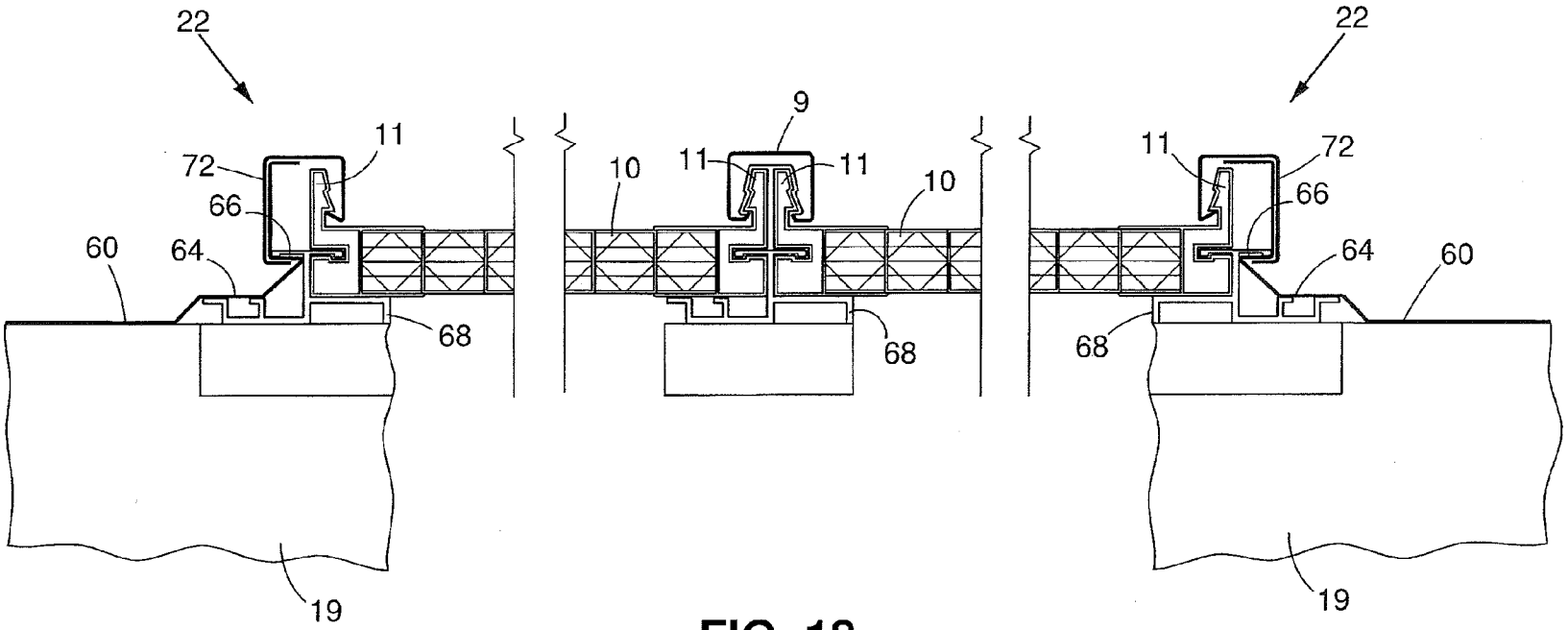
FIG. 18 is a cross sectional view of the embodiment of FIG. 18.
Figure 22:
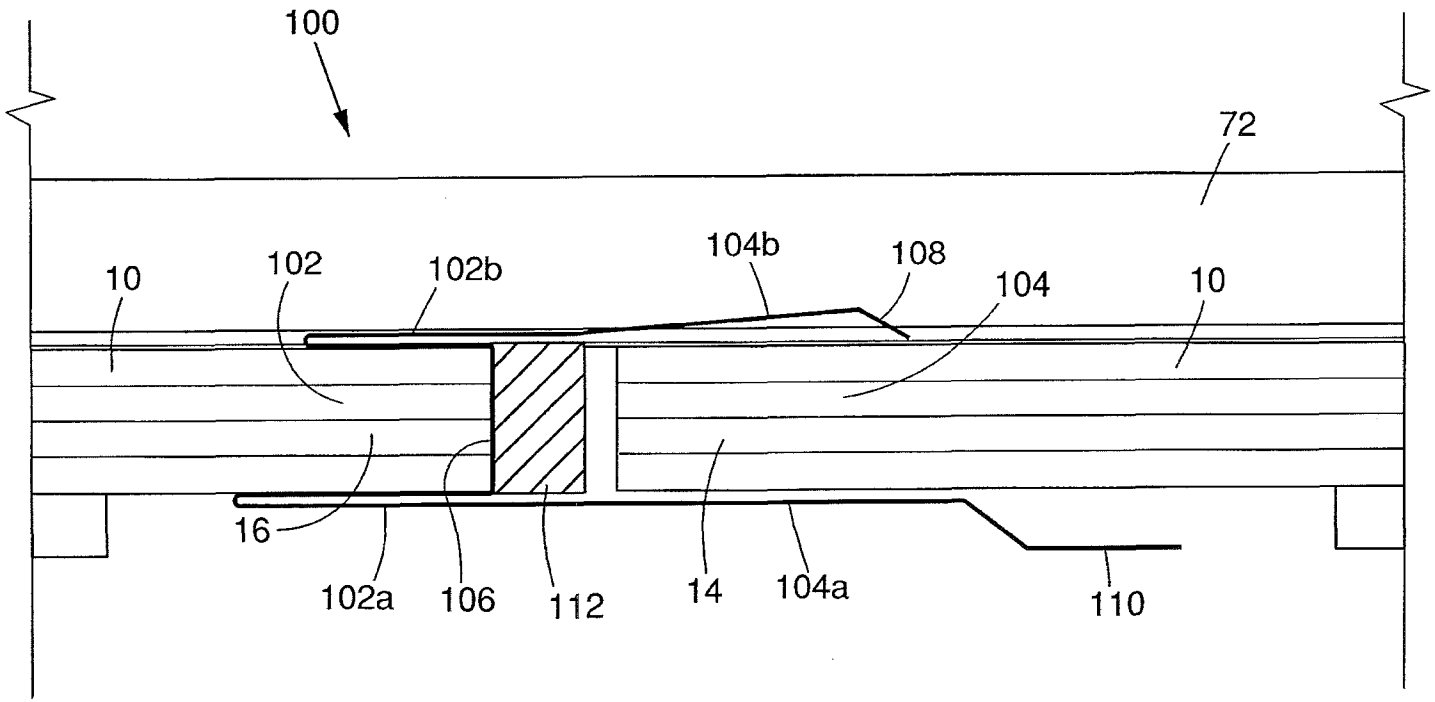
FIG. 22 is an enlarged sectional view of a panel joining component joining two window panels together.
Figure 23:
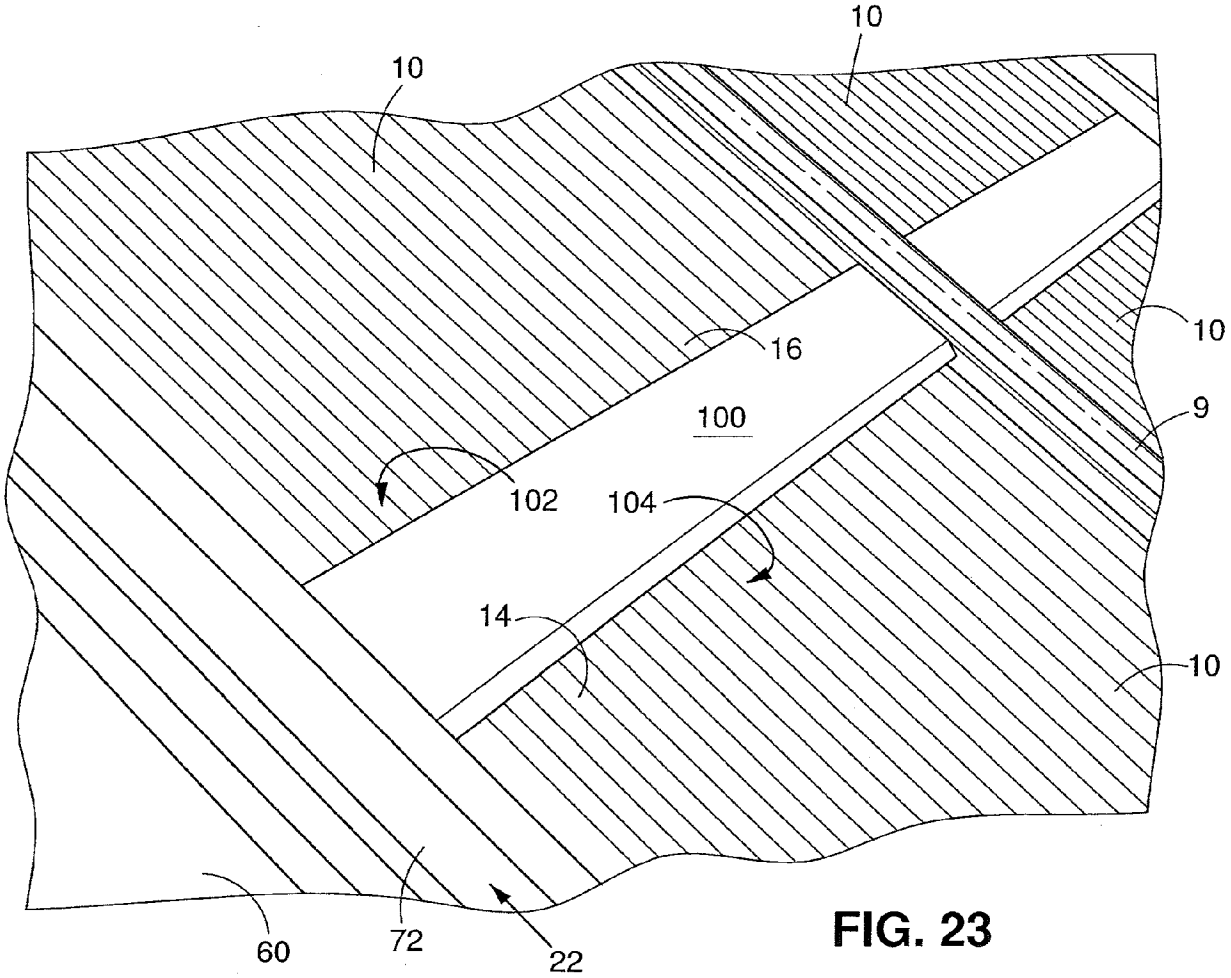
FIG. 23 is a perspective view of a portion of window panels joined together with a panel joining component.

FIGS. 17-23 depict another embodiment of an interface securement system 20 and a window assembly 28 which can include a panel joining component 100 for joining the bottom 16 and top 14 ends of two window panels 10 together. The panel joining component 100 can have an uphill panel slot 102 for accepting the bottom end 16 of an uphill window panel 10, and a downhill panel slot 104 for accepting the top end 14 of a downhill window panel 10. The panel joining component 100 can be formed from a single piece of 24 gauge steel sheet metal bent into a generally H shaped cross-section with the uphill panel slot 102 having opposing interior 102*a* and exterior 102*b* walls with two layers of sheet metal, and the downhill panel slot 104 having opposing interior 104*a* and exterior 104*b* walls with a single layer of sheet metal (FIG. 22). The uphill panel slot 102 can also have an end wall 106. The interior walls 102*a* and 104*a* can be longer or wider than the opposing exterior walls 102*b* and 104*b* to facilitate insertion of the window panels 10. The uphill window panel 10 can be sealed within the uphill slot 102 with a sealant.

The exterior wall 104*b* of the downhill slot 104 can have a bent, angled, or curved end or edge 108 for contacting the top end 14 of the downhill window panel 10 along a resilient contact or seal line, which can allow movement of the window panel 10 within the downhill slot 104 while remaining sealed. The interior wall 104*a* can have an extended portion 110 that can be bent to allow the window panel 10 to rest upon it before insertion. A resilient or compressible member, seal or gasket 112 can be positioned within the downhill slot 104 to provide sealing, as well as absorb vibration from wind, absorb shock and keep dust from accumulating.

Figure 19:
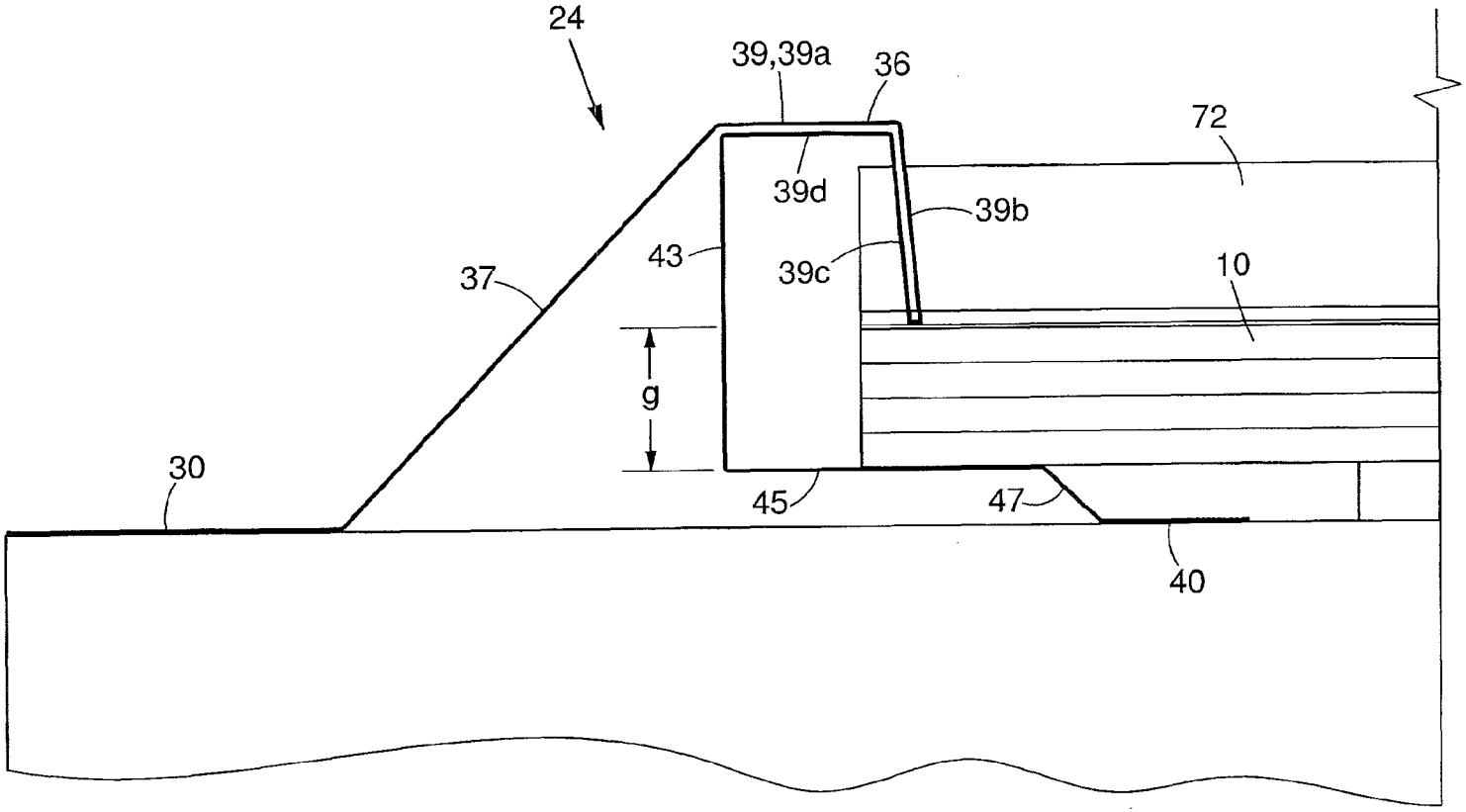
FIG. 19 is an enlarged sectional view of an embodiment of a header panel gripping a window panel.

Referring to FIG. 19, the header panel 24 in use, can have deflection in at least one of the first 39*a* and second 39*b* portions of the exterior slot member 39, as shown, for resiliently gripping the window panel 10. For example, the second portion 39*b* can deflect in the downhill direction.

Figure 20:
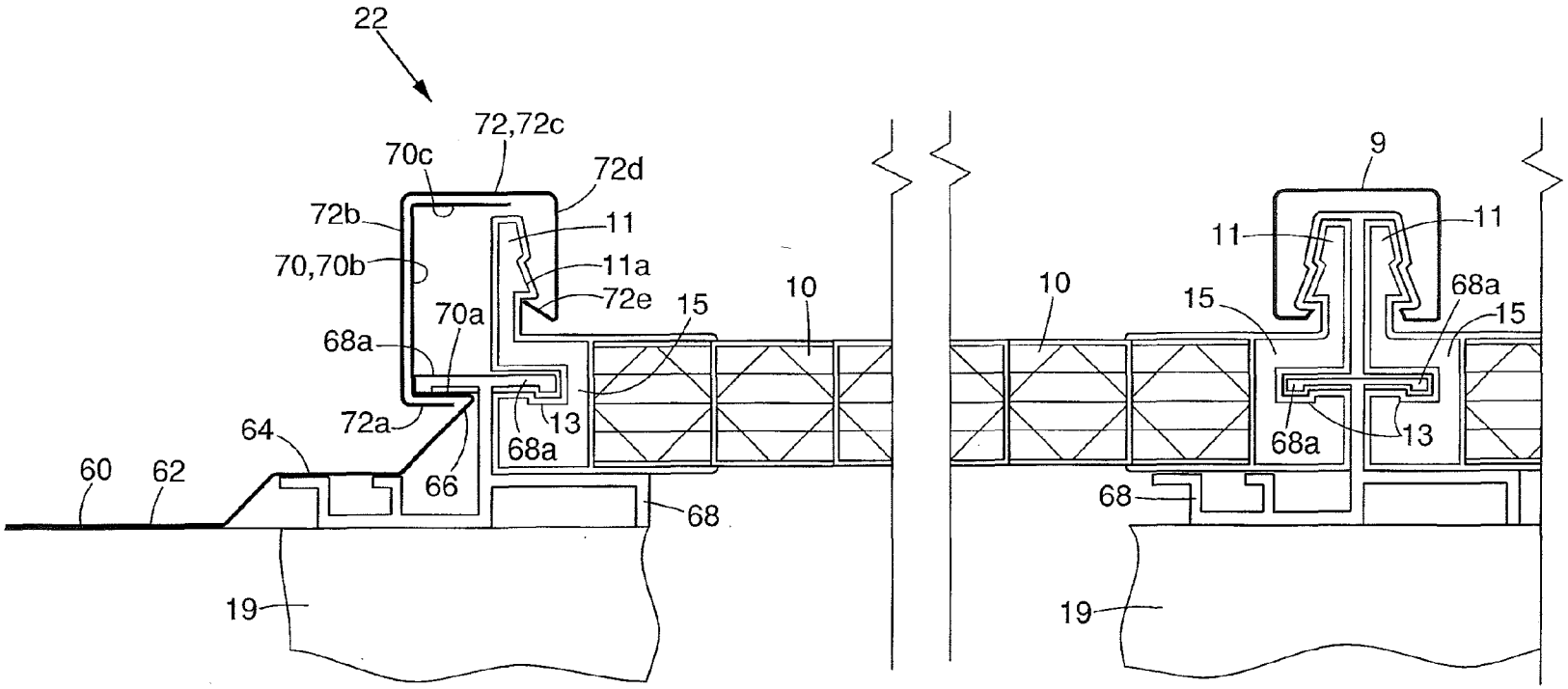
FIG. 20. is an enlarged sectional view of an embodiment of a side structure secured to a window panel.

Referring to FIG. 20, the engagement ridge 66 of the side panel 60 can be positioned such that the arm 68*a* of the retention structure 68 extends into the corner of the channel shaped structure 70 between leg 70*a* and wall 70*b*, which can provide further strength and rigidity.

Referring to FIG. 21, the exterior slot member 94*c* of the retention slot 94 can have a bent, curved or angled uphill edge 114 for resiliently engaging and sealing against the exterior surface of the window panel 10 in a manner that allows sealed thermal expansion movement.

Although FIGS. 1-23 have been shown for securing roof window panels 10 to a roof 18, it is understood that the window panels 10 in other embodiments can be secured to the walls of a structure and can be interfaced with the siding of the structure in a similar manner. The header panel 24, side panels 60, channel cap 72 and sill panel 26 can be formed or bent from sheet metal, such as steel. In other embodiments, some or all of these components can be formed by other suitable methods, including molding or fabrication, or formed of other suitable metals or of nonmetallic materials.

The present invention can provide a simple to install water tight method for the use of roof or window panels, and can isolate the metal roof/siding system from the roof or window system to control thermal expansion differences between the two dissimilar materials, and the header panel 24, side structures 22, and sill panel 26 can allow thermal expansion movement with live or moving sealing relative to the window panels 10. The same materials used in the roof/siding system can be used in order to maintain factory roofing warranties. Field formed flashing systems and sealants which may harm panels can be eliminated, and the need to mechanically fasten or penetrate the panel system can be eliminated. The present invention can be designed and tested to meet building codes, wind uplift, and engineering standards, and can be installed with standard tools and basic roofing/siding practices. The present invention can create a low profile (non curb mounted) roof glazing system, and can be installed on low slope, steep slop roofs or vertically into wall systems. A modular construction can allow for systems much larger than standard windows or skylights. The present invention can be manufactured using C.N.C. forming equipment insuring product consistency.

While this invention has been particularly shown and described with references to example embodiments thereof, it will be understood by those skilled in the art that various changes in form and details may be made therein without departing from the scope of the invention encompassed by the appended claims.

For example, various dimensions can vary depending upon the situation at hand. The various terms of direction given, can change or vary depending upon the orientation of the components.

What is claimed is:

1. A securement system for a roof or window panel comprising:

a first side structure for securing and sealing a first side of the roof or window panel comprising a first side panel having an outer side flange for interfacing with roofing or siding, a raised cricket extending inwardly from the outer side flange for directing water away from the first side of the roof or window panel, an elongate engagement ridge extending laterally outwardly from an inner edge of the cricket for engaging an underside of a retention structure extending along the first side of the roof or window panel mounted to a roof member, and then extending in an exterior direction, and an elongate open polygonal channel cap having an outer edge for engaging at least one of an underside of the elongate engagement ridge of the first side panel cricket and the underside of the retention structure, and an inner edge for engaging an elongate upright ridge extending from the roof or window panel in the exterior direction, the cap having an exterior connecting wall and resiliently deflectable outer and inner side walls extending from opposite sides of the exterior connecting wall in an interior direction, the outer and inner edges of the cap extending from respective outer and inner side walls with an elongate opening therebetween, the outer and inner side walls of the cap configured to be resiliently deflectable away from each other during installation over the elongate engagement ridge of the first side panel cricket and the upwardly extending elongate ridge of the roof or window panel, respectively, and resiliently snapped in place around and for securing the elongate engagement ridge of the cricket and the elongate upright ridge extending from the roof or window panel together, and providing waterproofing and rigidity to the first side structure.

2. The securement system of claim 1, in which the retention structure comprises at least one anchor member secured to the first side of the roof or window panel.

3. The securement system of claim 2, in which the at least one anchor member engages a structure along the first side of the roof or window panel.

4. The securement system of claim 1 in which the open polygonal channel cap is elongate and has a cross section with a laterally inwardly extending side panel engagement leg forming the outer edge for engaging the engagement ridge of the first side panel, the outer side wall extending in an exterior direction from the side panel engagement leg, the exterior connecting wall extending laterally inwardly from the outer side wall, the inner side wall extending in the interior direction from the exterior connecting wall and terminating in an outwardly angled window panel engagement leg forming the inner edge that extends in an angled direction toward the outer side wall and the exterior connecting wall.

5. The securement system of claim 4 in which in the cross section of the open polygonal channel cap, the side panel engagement leg is shorter than the exterior connecting wall, the inner side wall is shorter than the outer side wall, and the window panel engagement leg is shorter than the exterior connecting wall.

6. The securement system of claim 5 in which the open polygonal channel cap is formed of sheet metal, with respective bent corners between the side panel engagement leg and the outer side wall, between the outer side wall and the exterior connecting wall, between the exterior connecting wall and the inner side wall, and between the inner side wall and the window panel engagement leg.

7. The securement system of claim 6 in which in the cross section of the open polygonal channel cap, the side panel engagement leg is about .33 inches, the outer side wall is about 1.3 inches, the exterior connecting wall is about .95 inches, the inner side wall is about .8 inches, and the window panel engagement leg is about .25 inches.

8. The securement system of claim 1 in which the open polygonal channel cap has a cross section comprising a perimeter with 5 sides with an opening between the outer edge and the inner edge.

9. The securement system of claim 1 in which the engagement ridge of the side panel extends laterally outwardly from the raised side panel cricket and is generally channel shaped for engaging the open polygonal channel cap.

10. The securement system of claim 9 in which the side panel is formed of sheet metal and the engagement ridge has a retention structure engagement leg bent laterally outwardly from the side panel raised cricket, the outer side wall bent from the retention structure engagement leg in the exterior direction, and an exterior wall bent laterally inwardly from the outer side wall.

11. The securement system of claim 10 in which in a cross section of the engagement ridge, the retention structure engagement leg is about .43 inches, the outer side wall is about 1.25 inches and the exterior wall is about .65 inches.

12. The securement system of claim 10 in which the open polygonal channel cap engages the retention structure engagement leg, the outer side wall and the exterior wall.

* * * * *